US012369711B2

(12) United States Patent
Chen et al.

(10) Patent No.: US 12,369,711 B2
(45) Date of Patent: Jul. 29, 2025

(54) SLIDE RAIL MECHANISM

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Yi-Syuan Jhao, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 225 days.

(21) Appl. No.: 18/198,849

(22) Filed: May 18, 2023

(65) Prior Publication Data

US 2024/0245213 A1 Jul. 25, 2024

(30) Foreign Application Priority Data

Jan. 19, 2023 (TW) ..... 112103214

(51) Int. Cl.
*A47B 88/49* (2017.01)
*A47B 88/447* (2017.01)

(52) U.S. Cl.
CPC ..... *A47B 88/49* (2017.01); *A47B 88/447* (2017.01); *A47B 2210/0067* (2013.01)

(58) Field of Classification Search
CPC . A47B 88/49; A47B 88/447; A47B 2097/008; A47B 2210/0067
USPC ..... 312/107.5, 216, 221
See application file for complete search history.

(56) References Cited

U.S. PATENT DOCUMENTS 1,486,094 A * 3/1924 Lehman ..... E05B 65/0003 235/22
2,848,293 A 8/1958 Jurgens
3,767,280 A * 10/1973 McLaughlin ..... E05B 65/462 312/219
3,941,441 A 3/1976 Scheerhorn
4,609,233 A * 9/1986 Walla ..... E05B 65/462 70/120
5,352,030 A * 10/1994 Derle ..... E05B 65/464 312/220
5,772,294 A * 6/1998 Hendrich ..... E05B 65/464 312/334.8
5,988,778 A 11/1999 Lammens
(Continued)

FOREIGN PATENT DOCUMENTS

FR 2 240 643 A5 3/1975
IT 20 130 080 A1 10/2014
(Continued)

*Primary Examiner* — James O Hansen
(74) *Attorney, Agent, or Firm* — Winston Hsu

(57) ABSTRACT

A slide rail mechanism is configured to a cabinet. The slide rail mechanism includes a first rail assembly, a second rail assembly and a working member. The first and second assemblies are arranged on the cabinet. The working member is shiftable with respect to the cabinet. When a second rail of the first rail assembly is opened with respect to a first rail, the working member is moved in a transverse direction for preventing a fourth rail of the second rail assembly to be opened from a retracted position with respect to a third rail.

16 Claims, 17 Drawing Sheets

(56) References Cited

U.S. PATENT DOCUMENTS

| | | | | |
|---|---|---|---|---|
| 6,254,205 | B1 * | 7/2001 | Wright | E05B 65/464 312/217 |
| 6,296,332 | B1 | 10/2001 | Lammes | |
| 6,550,876 | B2 | 4/2003 | Lammens | |
| 7,320,507 | B2 | 1/2008 | White | |
| 7,823,992 | B2 | 11/2010 | Chen | |

FOREIGN PATENT DOCUMENTS

| | | | |
|---|---|---|---|
| JP | 53-28441 | U | 3/1978 |
| JP | 55-74965 | U | 5/1980 |
| JP | 61-84977 | U | 6/1986 |
| JP | 7-100026 | A | 4/1995 |
| JP | 8-275833 | A | 10/1996 |
| JP | 9-28484 | A | 2/1997 |
| JP | 2000-282736 | A | 10/2000 |

* cited by examiner

SLIDE RAIL MECHANISM

BACKGROUND OF THE INVENTION

1. Field of the Invention

The present invention relates to a slide rail system, and more particularly, to a slide rail mechanism including a plurality of slide rail assemblies and only pulling open one of the slide rail assemblies in each operation.

2. Description of the Prior Art

U.S. Pat. No. 7,520,576B2 discloses an anti-tilt linkage mechanism that is applied for a vertical cabinet with several movable drawers. The vertical cabinet includes a file cabinet body, telescopic slide rails and two or more drawers. The telescopic slide rails are installed on the inner wall of the file cabinet body. The drawers are vertically installed inside the file cabinet body via the telescopic slide rails; when one drawer is pulled open, the other drawers cannot be pulled out from the file cabinet body.

However, the linkage mechanism of the foresaid patent is only suitable for two or more slide rails (or the related drawers) that are installed in a vertical manner. Design of a linkage product of satisfying market competition and different operation demands is an important issue in the institutional design industry.

SUMMARY OF THE INVENTION

The present invention provides slide rail mechanism including a plurality of slide rail assemblies and only pulling open one of the slide rail assemblies in each operation for solving above drawbacks.

According to the claimed invention, a slide rail mechanism is configured to a cabinet. The slide rail mechanism includes a first slide rail assembly, a second slide rail assembly and a first working member. The first slide rail assembly and the second slide rail assembly are arranged on the cabinet. The first working member is shiftable with respect to the cabinet. The first slide rail assembly includes a first rail and a second rail. The second rail is shiftable with respect to the first rail in a longitudinal direction, and the second slide rail assembly includes a third rail and a fourth rail, and the fourth rail is shiftable with respect to the third rail in the longitudinal direction. When the second rail is shifted with respect to the first rail of the first slide rail assembly in an actuation direction, the first working member is driven to shift in a first transverse direction, so as to prevent the fourth rail from being shifted with respect to the third rail of the second slide rail assembly in the actuation direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
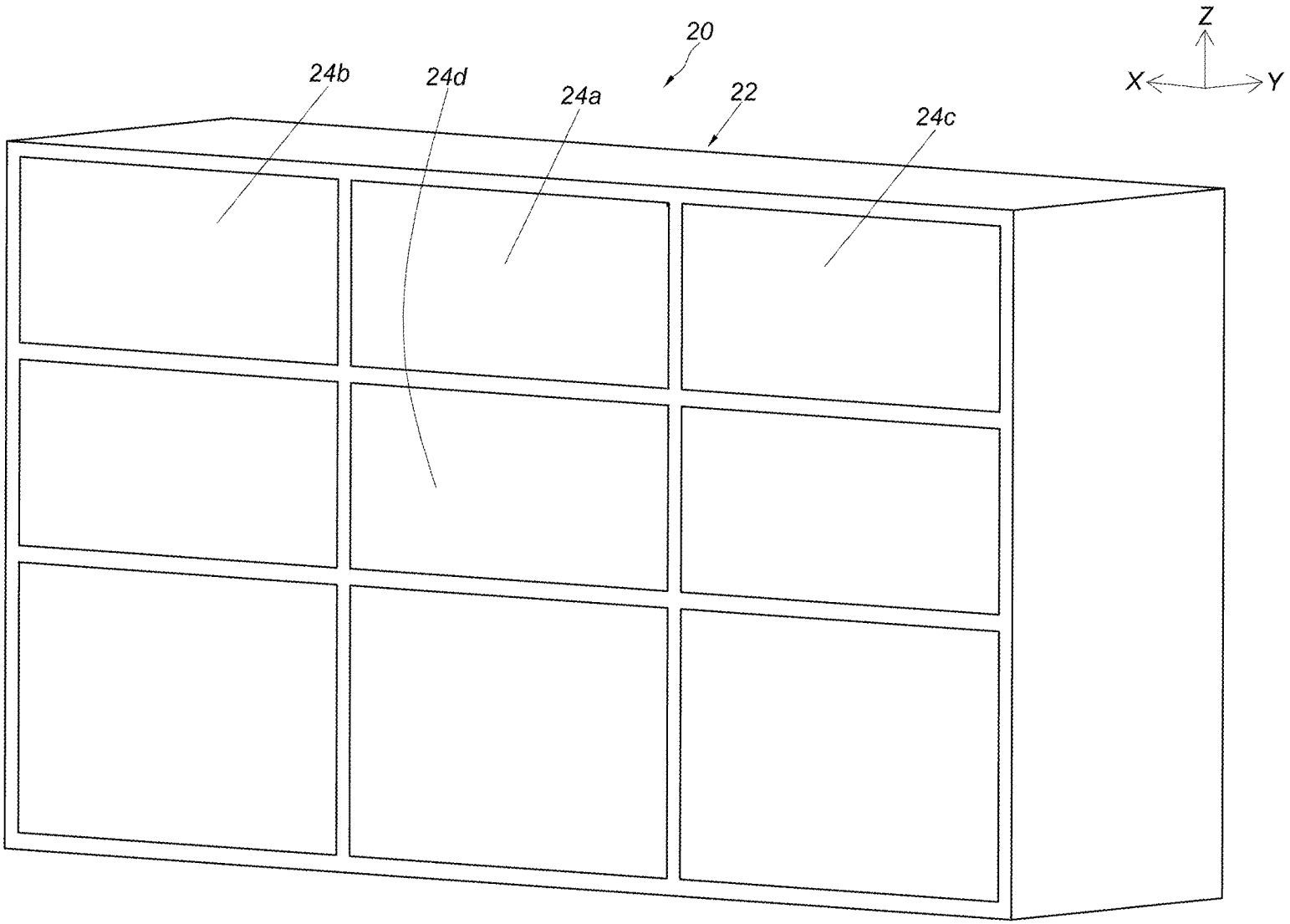
FIG. 1 is a diagram of furniture including a cabinet and a plurality of drawers according to a first embodiment of the present application.

Please refer to FIG. 1. In the first embodiment of the present application, furniture 20 can include a cabinet 22, and the cabinet 22 can include a plurality of drawers arranged in a transverse direction (such as lateral arrangement) and a plurality of drawers arranged in a vertical direction, such as a first drawer 24*a*, a second drawer 24*b*, a third drawer 24*c* and a fourth drawer 24*d* shown in FIG. 1, and others are omitted herein for simplicity. The drawers can be pulled open and pushed into the cabinet 22.

Figure 2:
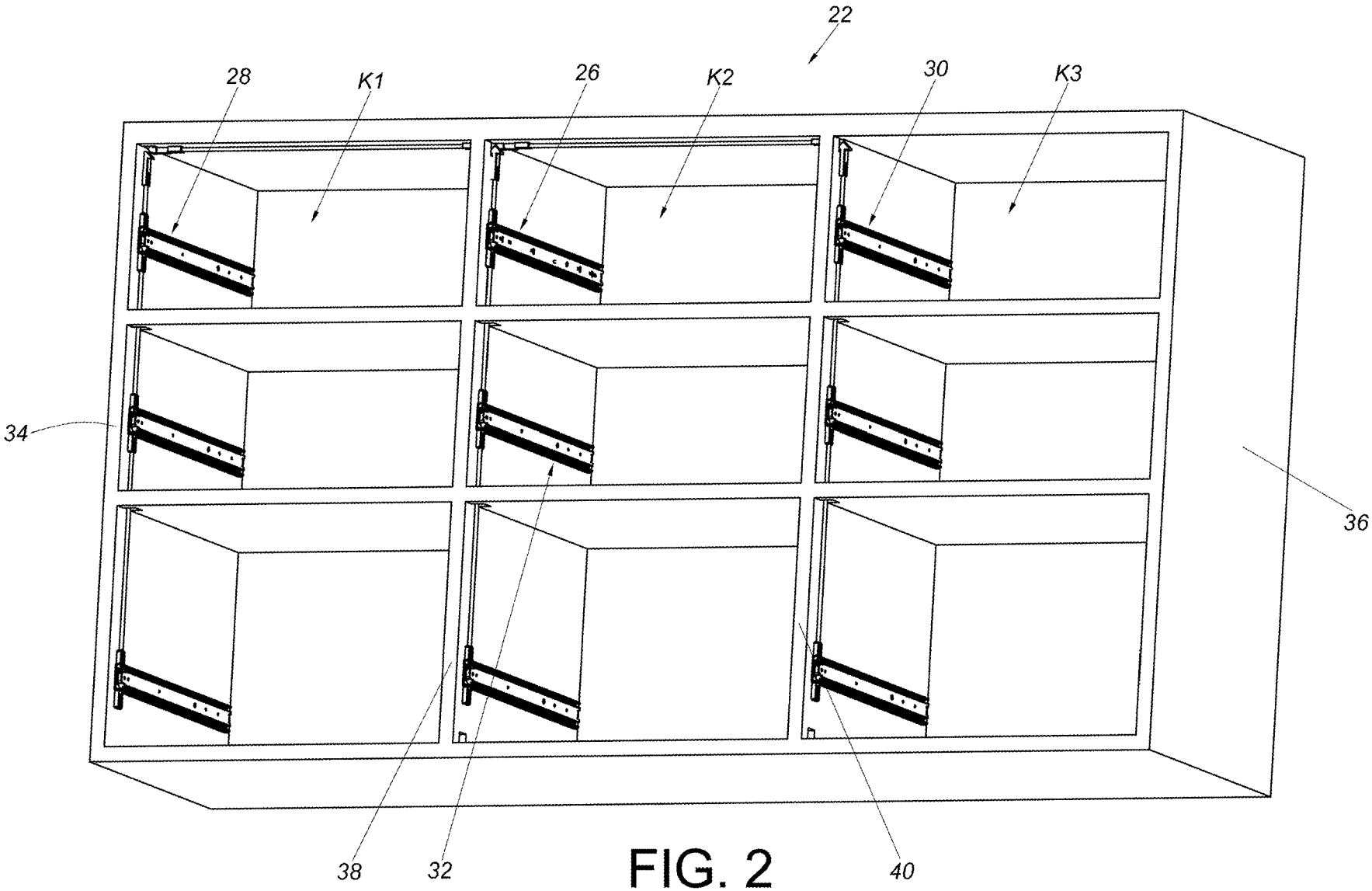
FIG. 2 is a diagram of a slide rail mechanism applied to the cabinet according to the first embodiment of the present application.
Figure 3:
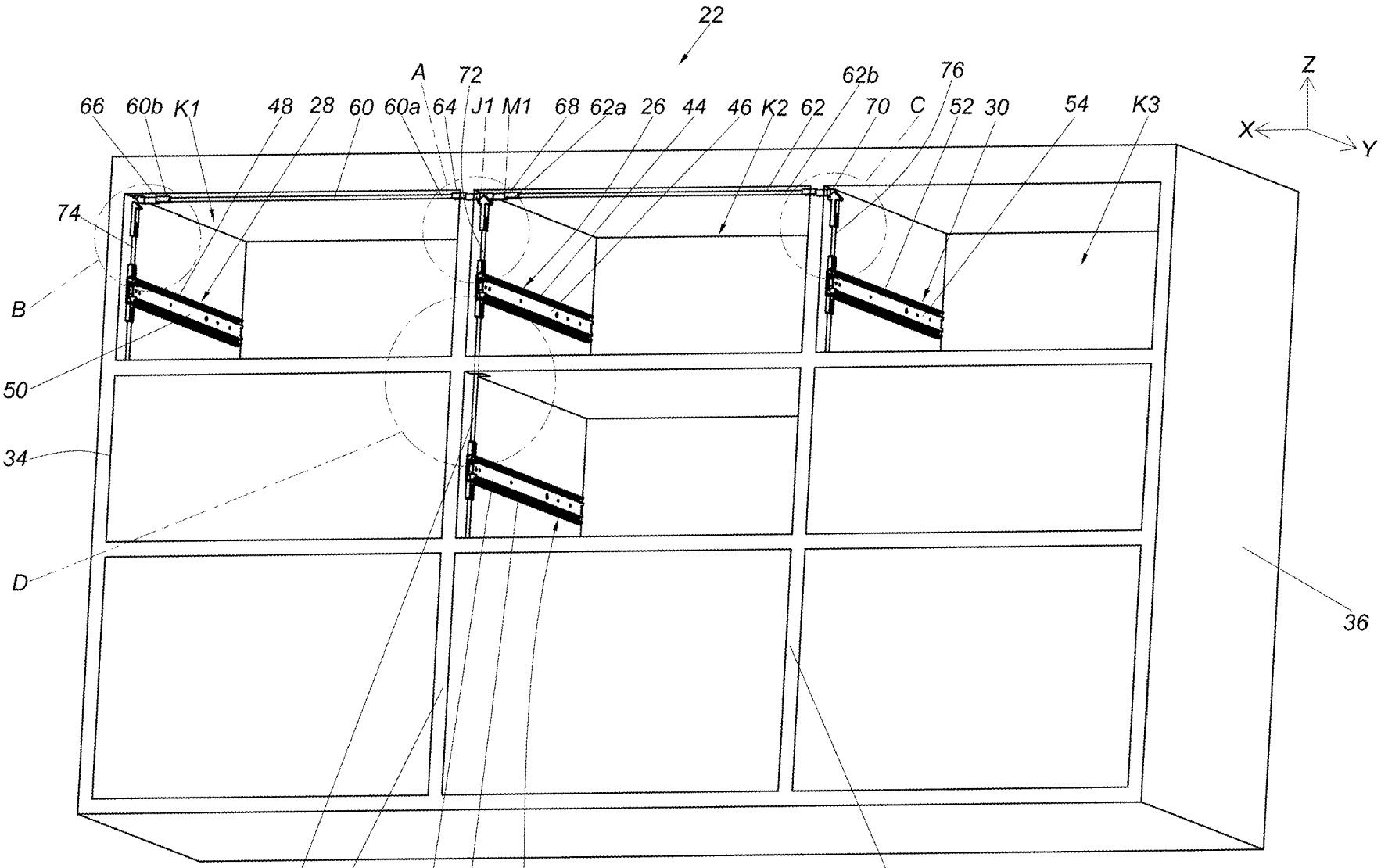
FIG. 3 is a diagram of the slide rail mechanism applied to the cabinet and the plurality of drawers according to the first embodiment of the present application.

Please refer to FIG. 2 and FIG. 3. A slide rail mechanism can be arranged inside the cabinet 22. The slide rail mechanism can include a plurality of slide rail assemblies, such as a first slide rail assembly 26, a second slide rail assembly 28, a third slide rail assembly 30 and a fourth slide rail assembly 32 respectively configured to hold the first drawer 24*a*, the second drawer 24*b*, the third drawer 24*c* and the fourth drawer 24*d*. Each of the first slide rail assembly 26, the second slide rail assembly 28, the third slide rail assembly 30 and the fourth slide rail assembly 32 can include at least two slide rails being shiftable with respect to each other in a longitudinal direction. In the embodiment, the longitudinal direction can be defined as X-axis direction (or can be interpreted as a lengthwise direction or a shifting direction of the slide rail); the transverse direction can be defined as Y-axis direction (or can be interpreted as a lateral direction of the slide rail); a vertical direction can be defined as Z-axis direction (or can be interpreted as a height direction of the slide rail).

It should be mentioned that the first slide rail assembly 26, the second slide rail assembly 28, the third slide rail assembly 30 and the fourth slide rail assembly 32 can be designed as a pair of slide rails respectively arranged on the left side and the right side of the corresponding drawer.

Only parts of the foresaid pair of two slide rails, such as the first slide rail assembly 26, the second slide rail assembly 28, the third slide rail assembly 30 and the fourth slide rail assembly 32 can be shown in FIG. 2 and FIG. 3.

The cabinet 22 can include a plurality of stand walls, such as a first lateral wall 34, a second lateral wall 36, a first middle wall 38 and a second middle wall 40. The first middle wall 38 and the second middle wall 40 can be located between the first lateral wall 34 and the second lateral wall 36. The cabinet 22 can have some first spaces K1 located between the first lateral wall 34 and the first middle wall 38. The second drawer 24*b* can be accommodated inside one of the first spaces K1. The cabinet 22 can further have some second spaces K2 located between the first middle wall 38 and the second middle wall 40. The first drawer 24*a* and the fourth drawer 24*d* can be accommodated inside two of the second spaces K2. The cabinet 22 can further have some third space K3 located between the second middle wall 40 and the second lateral wall 36. The third drawer 24*c* can be accommodated inside one of the third spaces K3.

The first slide rail assembly 26, the second slide rail assembly 28, the third slide rail assembly 30 and the fourth slide rail assembly 32 can be arranged inside the cabinet 22. The first slide rail assembly 26, the second slide rail assembly 28 and the third slide rail assembly 30 can be transversely arranged inside the cabinet 22. In addition, the fourth slide rail assembly 32 and the first slide rail assembly 26 can be vertically arranged inside the cabinet 22.

The first slide rail assembly 26 can include a first rail 44 and a second rail 46. The second rail 46 can be shiftable with respect to the first rail 44 in the longitudinal direction. The second slide rail assembly 28 can include a third rail 48 and a fourth rail 50. The fourth rail 50 can be shiftable with respect to the third rail 48 in the longitudinal direction. Moreover, the third slide rail assembly 30 can include a fifth rail 52 and a sixth rail 54. The sixth rail 54 can be shiftable with respect to the fifth rail 52 in the longitudinal direction. The fourth slide rail assembly 32 can include a seventh rail 56 and an eighth rail 58. The eighth rail 58 can be shiftable with respect to the seventh rail 56 in the longitudinal direction. The first rail 44 of the first slide rail assembly 26, the third rail 48 of the second slide rail assembly 28, the fifth rail 52 of the third slide rail assembly 30, and the seventh rail 56 of the fourth slide rail assembly 32 can be mounted on the cabinet 22, such as in a fixed manner. The second rail 46 of the first slide rail assembly 26, the fourth rail 50 of the second slide rail assembly 28, the sixth rail 54 of the third slide rail assembly 30, and the eighth rail 58 of the fourth slide rail assembly 32 can be respectively configured to hold the first drawer 24*a*, the second drawer 24*b*, the third drawer 24*c* and the fourth drawer 24*d*. Preferably, each of the first slide rail assembly 26, the second slide rail assembly 28, the third slide rail assembly 30 and the fourth slide rail assembly 32 can further include a middle rail; that is to say, all the first slide rail assembly 26, the second slide rail assembly 28, the third slide rail assembly 30 and the fourth slide rail assembly 32 can be the three-rail slide rail assembly. For example, the middle rail of the first slide rail assembly 26 can be movably mounted between the first rail 44 and the second rail 46.

Please refer to FIG. 3 to FIG. 6. The slide rail mechanism can further include a first working member 60, and may preferably further include a second working member 62. In one possible example, each of the first working member 60 and the second working member 62 can be a rod, arrangement directions of the first working member 60 and the second working member 62 can be parallel to the transverse direction of the slide rail, and the first working member 60 and the second working member 62 can be shiftable with respect to the cabinet 22. The first working member 60 and the second working member 62 can be set in an initial mode; for example, the first working member 60 can be located on a first working position J1, and the second working member 62 can be located on a first preset position M1.

Preferably, the first working member 60 and the second working member 62 can be shiftable with respect to the cabinet 22 in the transverse direction. Therefore, moving directions of the first working member 60 and the second working member 62 can be substantially the same as the transverse direction (or the lateral direction) of the slide rail.

Preferably, the first working member 60 and the second working member 62 can be mounted on the cabinet 22 via a casing (which is not shown in the figures), so as to increase motion stability of the first working member 60 and the second working member 62 with respect to the cabinet 22.

Preferably, each of the first working member 60 and the second working member 62 can include two end portions. For example, the first working member 60 can include a first end portion 60*a* and a second end portion 60*b* opposite to each other, and the second working member 62 can include a first end portion 62*a* and a second end portion 62*b* opposite to each other.

Figure 4:
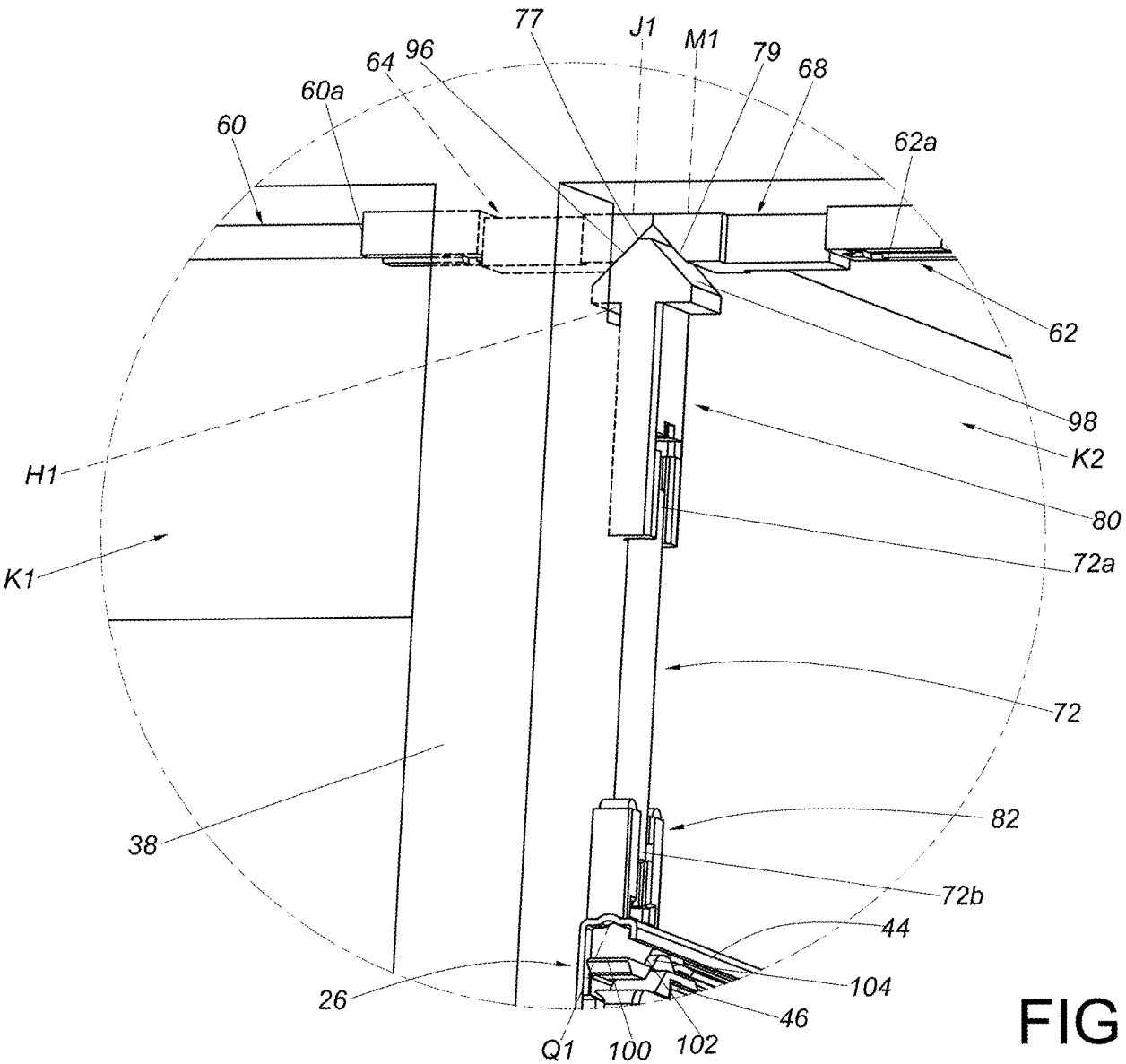
FIG. 4 is an enlarged diagram of an area A shown in FIG. 3.
Figure 5:
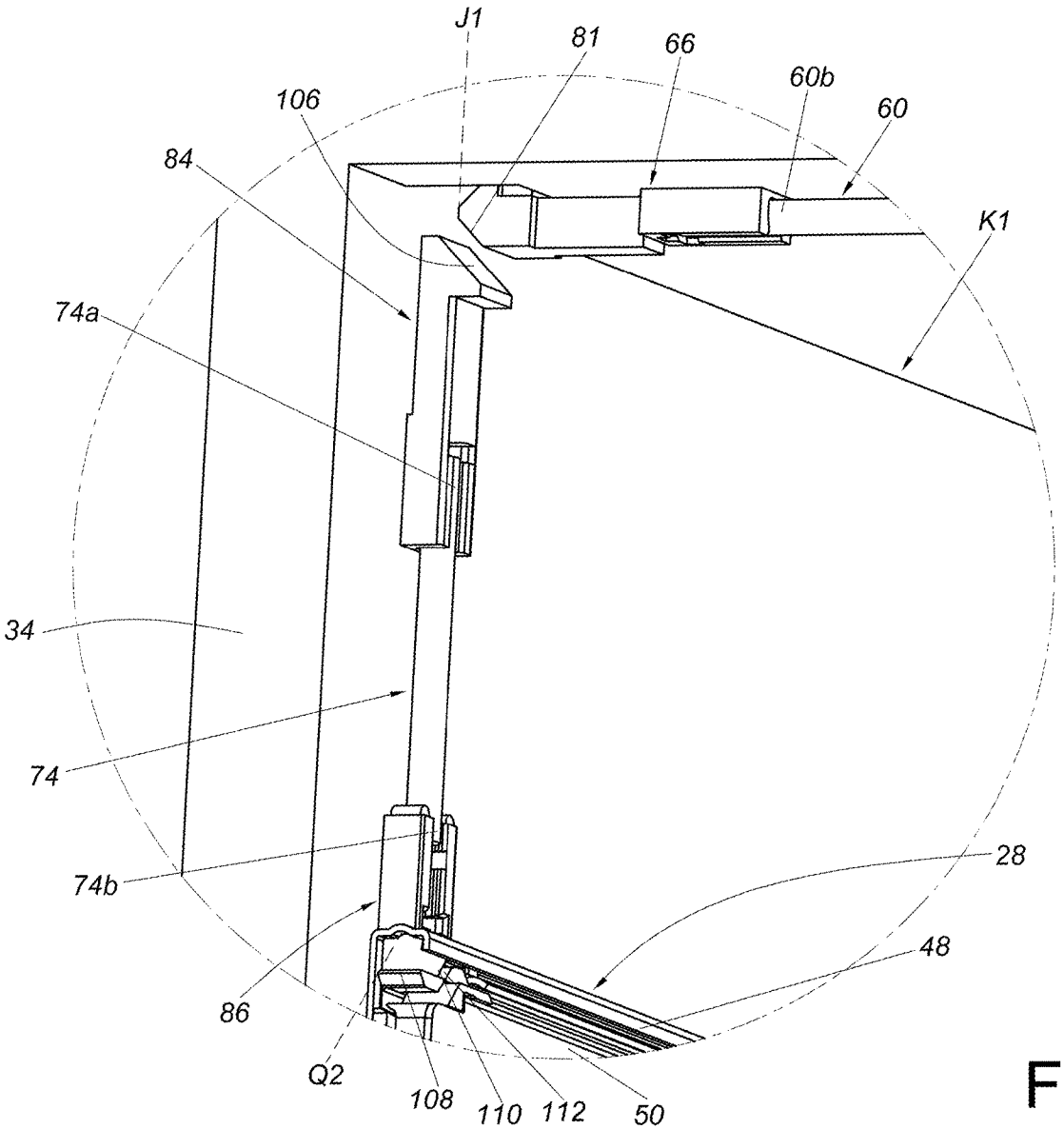
FIG. 5 is an enlarged diagram of an area B shown in FIG. 3.
Figure 6:
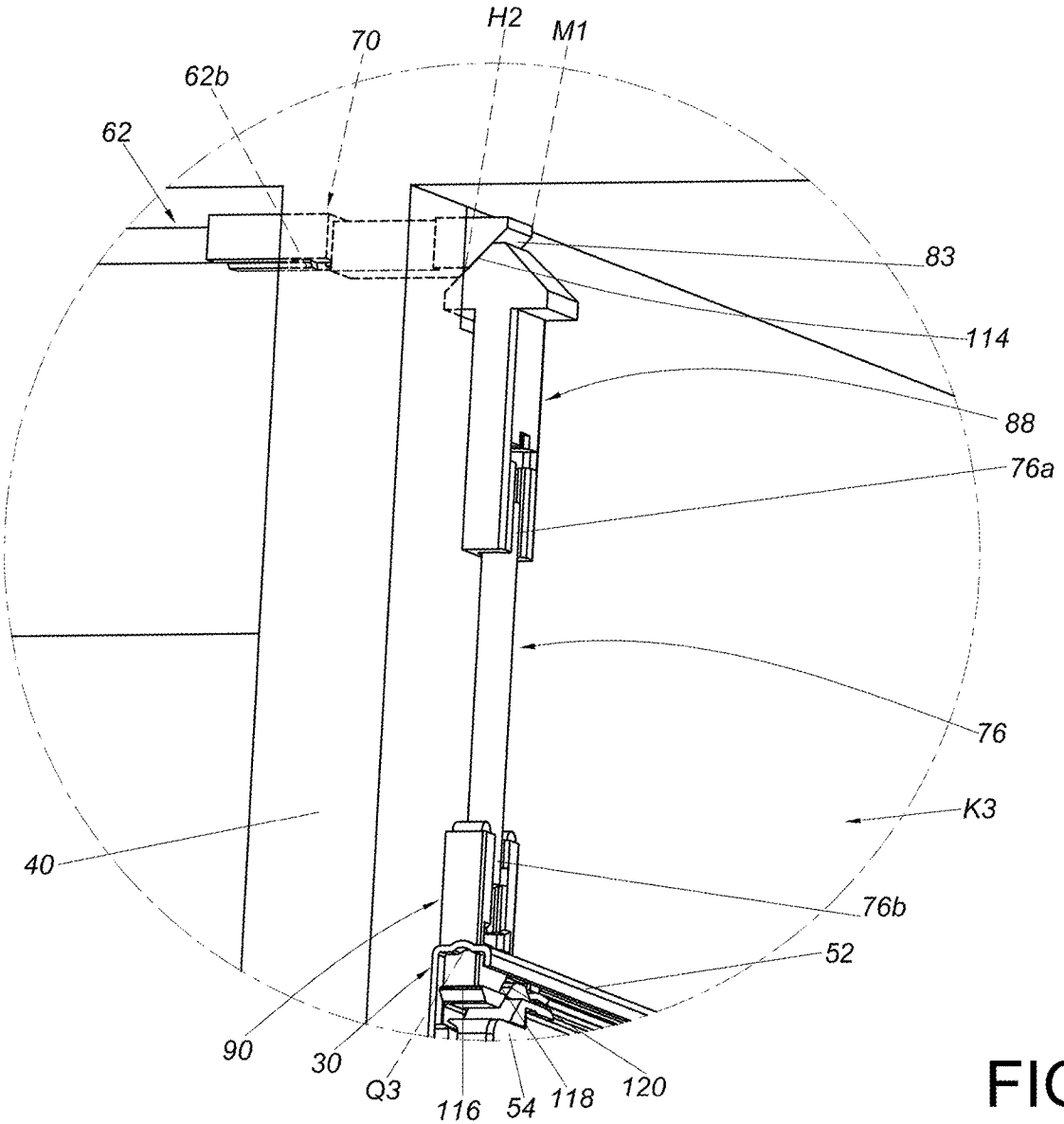
FIG. 6 is an enlarged diagram of an area C shown in FIG. 3.

Preferably, a first driving member 64 can be arranged on the first end portion 60*a* of the first working member 60 (which can be shown in FIG. 4), and a second driving member 66 can be arranged on the second end portion 60*b* of the first working member 60 (which can be shown in FIG. 5). Similarly, a third driving member 68 can be arranged on the first end portion 62*a* of the second working member 62 (which can be shown in FIG. 4), and a fourth driving member 70 can be arranged on the second end portion 62*b* of the second working member 62 (which can be shown in FIG. 6).

Preferably, most part of the first working member 60 can be located inside the first space K1. The cabinet 22 (or the first middle wall 38) can include a first hole H1 connected between the first space K1 and the second space K2 (which can be shown in FIG. 4), and other part (such as the first end portion 60*a* and the first driving member 64) of the first working member 60 can pass through the first hole H1 to enter the second space K2. Similarly, most part of the second working member 62 can be located inside the second space K2. The cabinet 22 (or the second middle wall 40) can include a second hole H2 connected between the second space K2 and the third space K3 (which can be shown in FIG. 6), and other part (such as the second end portion 62*b* and the second driving member 70) of the second working member 62 can pass through the second hole H2 to enter the third space K3.

Preferably, the slide rail mechanism can further include a first auxiliary member 72, a second auxiliary member 74, a third auxiliary member 76 and a fourth auxiliary member 78. Each of the first auxiliary member 72, the second auxiliary member 74, the third auxiliary member 76 and the fourth auxiliary member 78 can be the rod. In one possible example, arrangement directions of the first auxiliary member 72, the second auxiliary member 74, the third auxiliary member 76 and the fourth auxiliary member 78 can be parallel to the height direction of the slide rail, and the first auxiliary member 72, the second auxiliary member 74, the third auxiliary member 76 and the fourth auxiliary member 78 can be shiftable with respect to the cabinet 22.

Preferably, the first auxiliary member 72, the second auxiliary member 74, the third auxiliary member 76 and the fourth auxiliary member 78 can be vertically shiftable with respect to the cabinet 22; that is to say, moving directions of the first auxiliary member 72, the second auxiliary member 74, the third auxiliary member 76 and the fourth auxiliary member 78 can be substantially the same as the height direction of the slide rail.

Preferably, the first auxiliary member 72, the second auxiliary member 74, the third auxiliary member 76 and the fourth auxiliary member 78 can be mounted on the cabinet 22 via at least one casing (which is not shown in the figures), so as to increase motion stability of the first auxiliary member 72, the second auxiliary member 74, the third auxiliary member 76 and the fourth auxiliary member 78 with respect to the cabinet 22.

Preferably, each of the first auxiliary member 72, the second auxiliary member 74, the third auxiliary member 76 and the fourth auxiliary member 78 can include two end portions. For example, the first auxiliary member 72 can include a first end portion 72*a* and a second end portion 72*b* opposite to each other (which can be shown in FIG. 4), and the second auxiliary member 74 can include a first end portion 74*a* and a second end portion 74*b* opposite to each other (which can be shown in FIG. 5), and the third auxiliary member 76 can include a first end portion 76*a* and a second end portion 76*b* opposite to each other (which can be shown in FIG. 6), and the fourth auxiliary member 78 can include a first end portion 78*a* and a second end portion 78*b* opposite to each other (which can be shown in FIG. 7).

Figure 7:
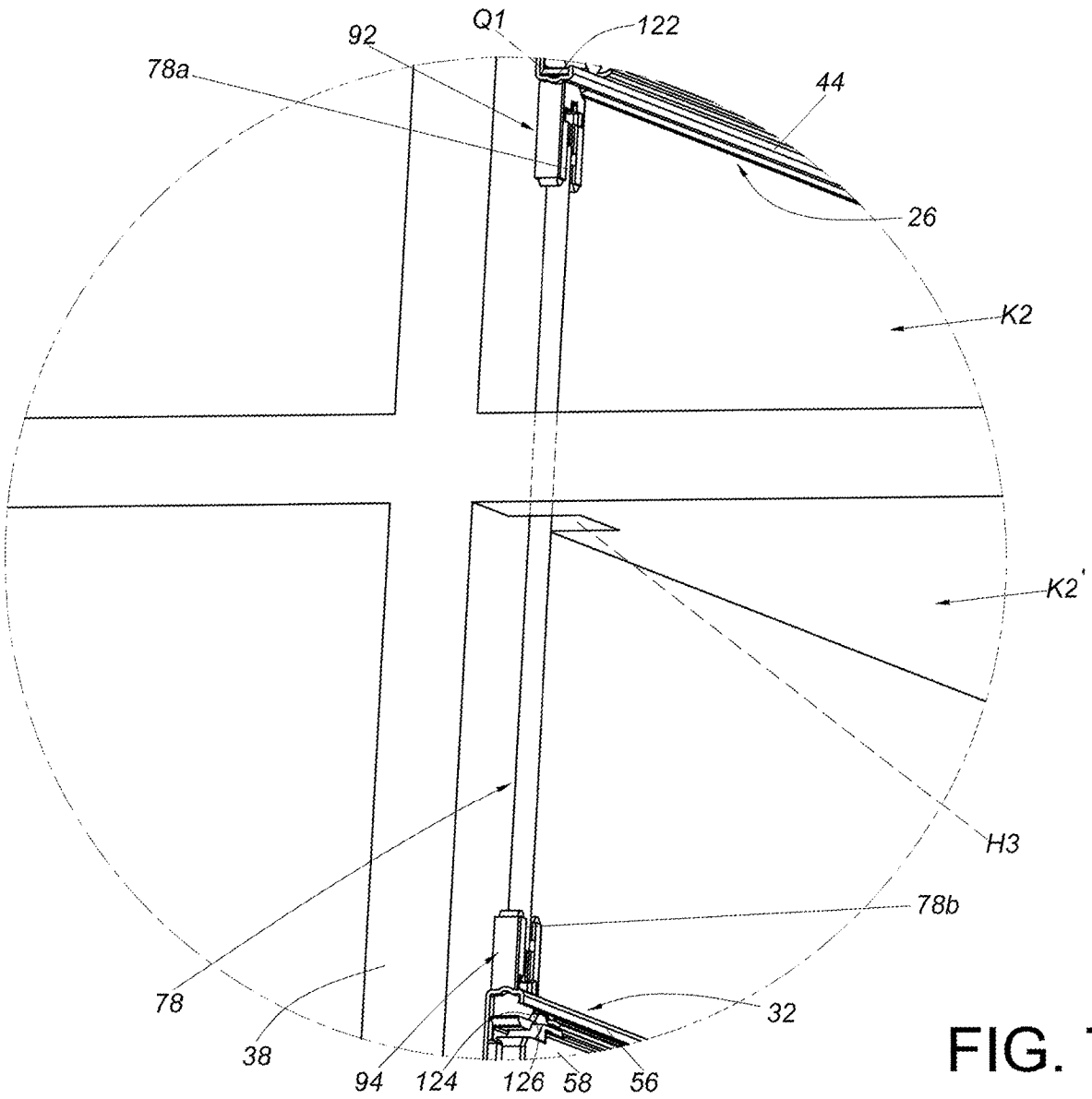
FIG. 7 is an enlarged diagram of an area D shown in FIG. 3.

Preferably, a first stretching member 80 can be arranged on the first end portion 72*a* of the first auxiliary member 72, and a second stretching member 82 can be arranged on the second end portion 72*b* of the first auxiliary member 72 (which can be shown in FIG. 4); a third stretching member 84 can be arranged on the first end portion 74*a* of the second auxiliary member 74, and a fourth stretching member 86 can be arranged on the second end portion 74*b* of the second auxiliary member 74 (which can be shown in FIG. 5); a fifth stretching member 88 can be arranged on the first end portion 76*a* of the third auxiliary member 76, and a sixth stretching member 90 can be arranged on the second end portion 76*b* of the third auxiliary member 76 (which can be shown in FIG. 6); a seventh stretching member 92 can be arranged on the first end portion 78*a* of the fourth auxiliary member 78, and an eighth stretching member 94 can be arranged on the second end portion 78*b* of the fourth auxiliary member 78 (which can be shown in FIG. 7). Preferably, the cabinet 22 (or the first middle wall 38) can include a third hole H3 connected between two second spaces K2 and K2' (which can be shown in FIG. 7).

Preferably, at least one guiding portion can be arranged on the first end portion 72*a* of the first auxiliary member 72; for example, a first guiding portion 96 and a second guiding portion 98 can be arranged on the first stretching member 80 of the first end portion 72*a*, and the first guiding portion 96 and the second guiding portion 98 can be an inclined typed structure or an arc typed structure (which can be shown in FIG. 4). Application of the first guiding portion 96 and the second guiding portion 98 is not limited to the foresaid embodiment, and depends on a design demand. In addition, the first auxiliary member 72 can be movably mounted on the first rail 44 of the first slide rail assembly 26 via the second stretching member 82. Moreover, a part of the second stretching member 82 arranged on the second end portion 72*b* of the first auxiliary member 72 can pass through a first preset space Q1 formed on the first rail 44; the second stretching member 82 can include a first constraining section 100, and the first constraining section 100 can abut against an inner wall of the first rail 44 for blocking, so that the first auxiliary member 72 can be shiftable with respect to the first rail 44 to an extreme position. Preferably, the second stretching member 82 can include a first guiding feature 102, and the first guiding feature 102 can be applied to a first corresponding feature 104 of the second rail 46. The first guiding feature 102 and the first corresponding feature 104 can be the inclined typed structure or the arc typed structure (which can be shown in FIG. 4); application of the first guiding feature 102 and the first corresponding feature 104 is not limited to the foresaid embodiment, and depends on the design demand.

Preferably, a guiding section can be arranged on the first end portion 60*a* of the first working member 60. For example, the first driving member 64 arranged on first end portion 60*a* can have a first guiding section 77; a guiding section can be arranged on the first end portion 62*a* of the second working member 62, for example, the third driving member 68 arranged on the first end portion 62*a* can have a second guiding section 79. The first guiding section 77 and the second guiding section 79 can be the inclined typed structure or the arc typed structure (which can be shown in FIG. 4); application of the first guiding section 77 and the second guiding section 79 is not limited to the foresaid embodiment, and depends on the design demand.

Preferably, at least one guiding portion can be arranged on the first end portion 74*a* of the second auxiliary member 74. For example, the third stretching member 84 arranged on the first end portion 74*a* can have a third guiding portion 106. The third guiding portion 106 can be the inclined typed structure or the arc typed structure (which can be shown in FIG. 5); application of the third guiding portion 106 is not limited to the foresaid embodiment, and depends on the design demand. In addition, the second auxiliary member 74 can be movably mounted on the third rail 48 of the second slide rail assembly 28 via the fourth stretching member 86. Moreover, a part of the fourth stretching member 86 arranged on the second end portion 74*b* of the second auxiliary member 74 can pass through a second preset space Q2 formed on the third rail 48; the fourth stretching member 86 can include a second constraining section 108, and the second constraining section 108 can abut against an inner wall of the third rail 48 for blocking, so that the second auxiliary member 74 can be shiftable with respect to the third rail 48 to the extreme position. Preferably, the fourth stretching member 86 can include a second guiding feature 110, and the second guiding feature 110 can be applied to a second corresponding feature 112 of the fourth rail 50. The second guiding feature 110 and the second corresponding feature 112 can be the inclined typed structure or the arc typed structure (which can be shown in FIG. 5); application of the second guiding feature 110 and the second corresponding feature 112 is not limited to the foresaid embodiment, and depends on the design demand.

Preferably, a guiding section can be arranged on the second end portion 60*b* of the first working member 60. For example, the second driving member 66 arranged on the second end portion 60*b* can include a third guiding section 81, and the third guiding section 81 can be the inclined typed structure or the arc typed structure (which can be shown in FIG. 5); application of the third guiding section 81 is not limited to the foresaid embodiment, and depends on the design demand.

Preferably, at least one guiding portion can be arranged on the first end portion 76*a* of the third auxiliary member 76. For example, the fifth stretching member 88 arranged on the first end portion 76*a* can include a fourth guiding portion 114. The fourth guiding portion 114 can be the inclined typed structure or the arc typed structure (which can be shown in FIG. 6); application of the fourth guiding portion 114 is not limited to the foresaid embodiment, and depends on the design demand. In addition, the third auxiliary member 76 can be movably mounted on the fifth rail 52 of the third slide rail assembly 30 via the sixth stretching member 90. Moreover, a part of the sixth stretching member 90 arranged on the second end portion 76*b* of the third auxiliary member 76 can pass through a third preset space Q3 formed on the fifth rail 52; the sixth stretching member 90 can include a third constraining section 116, and the third constraining section 116 can abut against an inner wall of the fifth rail 52 for blocking, so that the third auxiliary member 76 can be shiftable with respect to the fifth rail 52 to the extreme position. Preferably, the sixth stretching member 90 can include a third guiding feature 118, and the third guiding feature 118 can be applied for a third corresponding feature 120 of the sixth rail 54. The third corresponding feature 120 and the third guiding feature 118 can be the inclined typed structure or the arc typed structure (which can be shown in FIG. 6); application of the third corresponding feature 120 and the third guiding feature 118 is not limited to the foresaid embodiment, and depends on the design demand.

Preferably, a guiding section can be arranged on the second end portion 62*b* of the second working member 62. For example, the fourth driving member 70 arranged on the second end portion 62*b* can include a fourth guiding section 83, and the fourth guiding section 83 can be the inclined typed structure or the arc typed structure (which can be shown in FIG. 6); application of the fourth guiding section 83 is not limited to the foresaid embodiment, and depends on the design demand.

Preferably, a part of the seventh stretching member 92 arranged on the first end portion 78*a* of the fourth auxiliary member 78 can pass through a first preset space Q1 formed on the first rail 44 of the first slide rail assembly 26; a constraining section 122 can be arranged on the seventh stretching member 92 and can correspond to an inner wall of the first rail 44 (which can be shown in FIG. 7). Preferably, the eighth stretching member 94 arranged on the second end portion 78*b* of the fourth auxiliary member 78 can include a fourth guiding feature 124, and the fourth guiding feature 124 can be applied for a fourth corresponding feature 126 of the eighth rail 58. The fourth corresponding feature 126 and the fourth guiding feature 124 can be the inclined typed structure or the arc typed structure (which can be shown in FIG. 7); application of the fourth corresponding feature 126 and the fourth guiding feature 124 is not limited to the foresaid embodiment, and depends on the design demand.

Please refer to FIG. 4 to FIG. 7. The first end portion 72*a* (where on the first stretching member 80 is disposed) of the first auxiliary member 72 can correspond to somewhere between the first end portion 60*a* (where on the first driving member 64 is disposed) of the first working member 60 and the first end portion 62*a* (where on the third driving member 68 is disposed) of the second working member 62 (which can be shown in FIG. 4). The first end portion 74*a* (where on the third stretching member 84 is disposed) of the second auxiliary member 74 can correspond to the second driving member 66 arranged on the second end portion 60*b* of the first working member 60 (which can be shown in FIG. 5). The first end portion 76*a* (where on the fifth stretching member 88 is disposed) of the third auxiliary member 76 can correspond to the second end portion 62*b* (where on the fourth driving member 70 is disposed) of the second working member 62 (which can be shown in FIG. 6).

Figure 8:
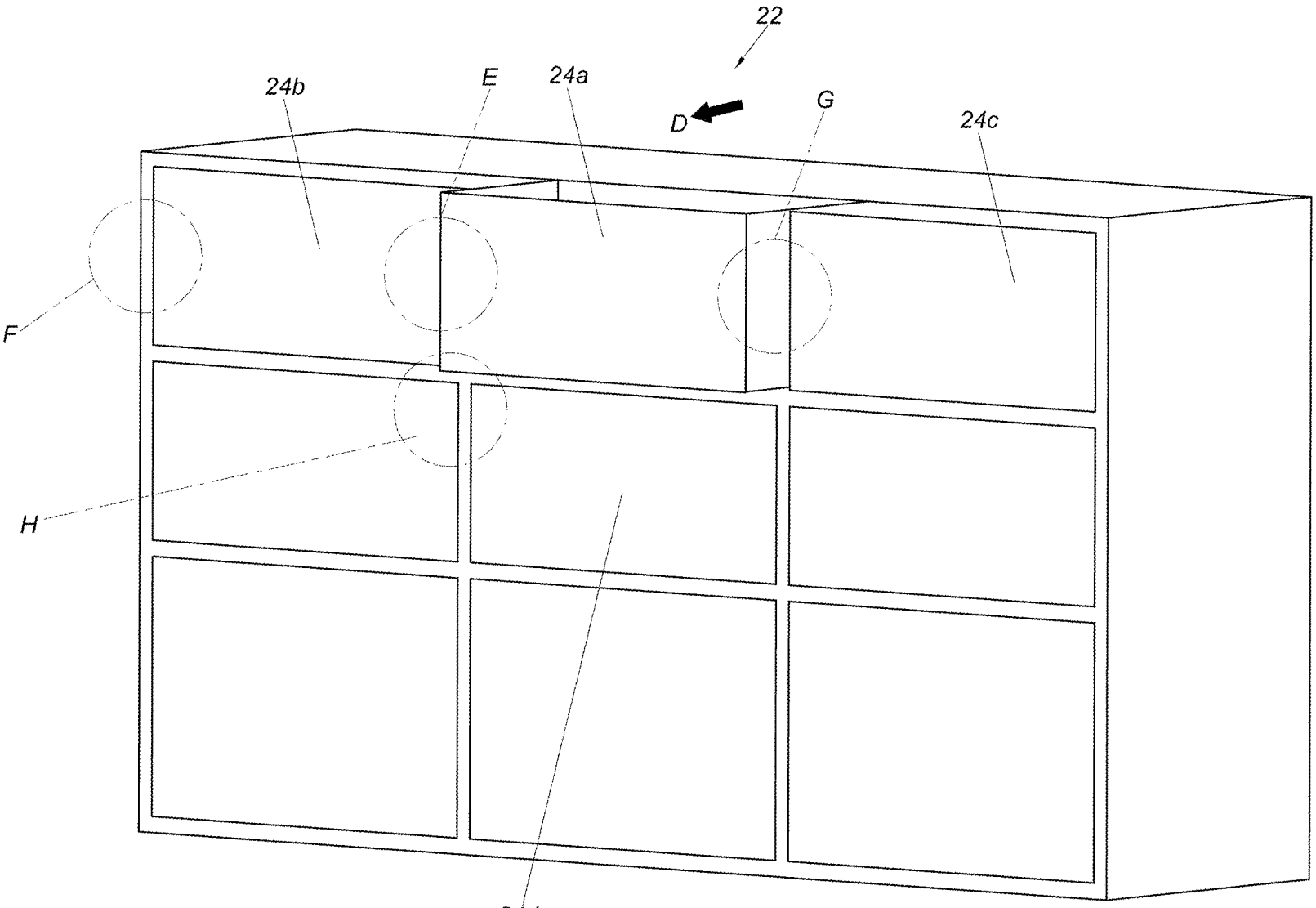
FIG. 8 is a diagram of the cabinet and one pulled-open drawer according to the first embodiment of the present application.
Figure 9:
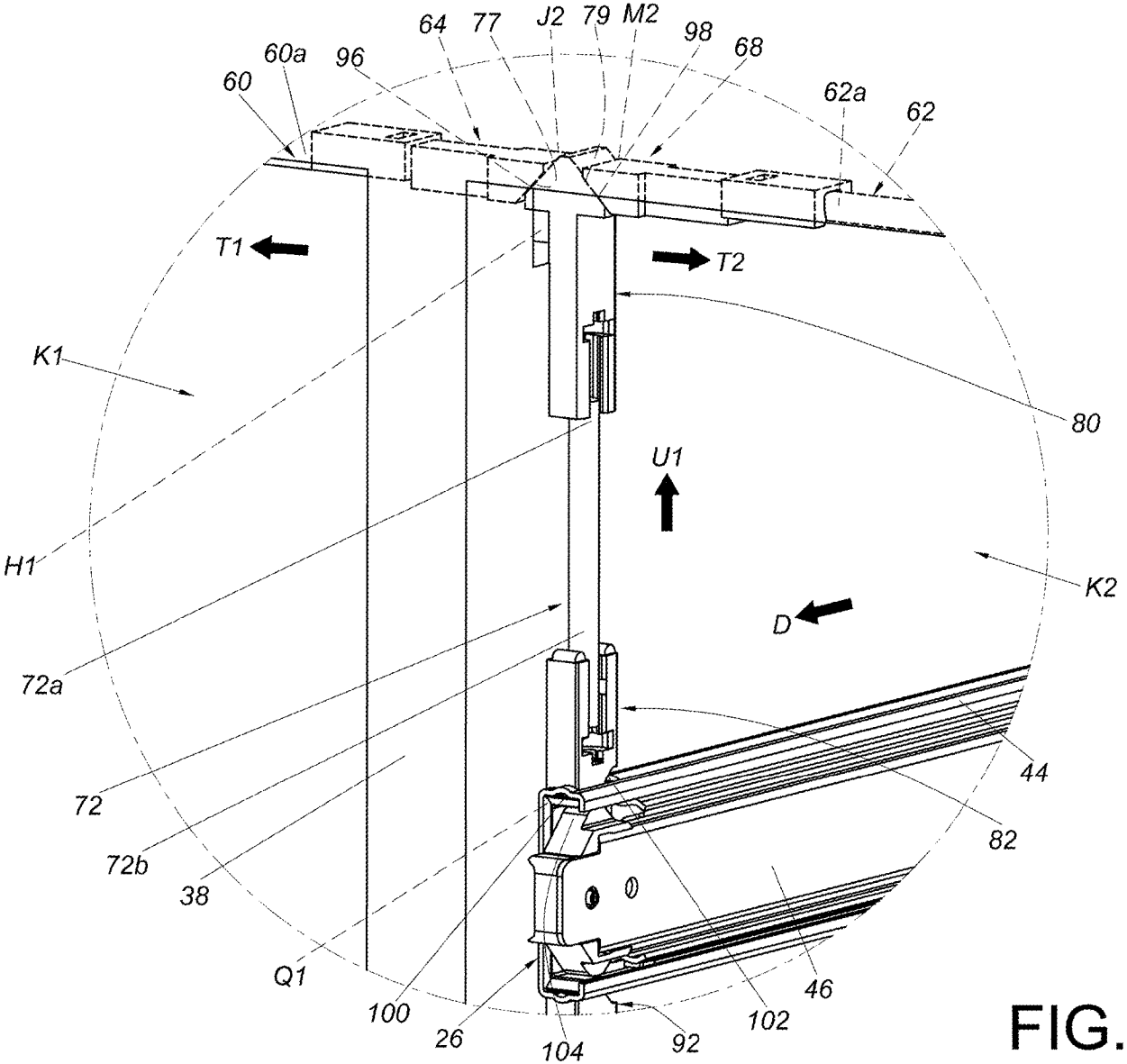
FIG. 9 is an enlarged diagram of an area E shown in FIG. 8.

As shown in FIG. 8, all the drawers of the cabinet 22 can be retractable for being pulled open and pushed into the cabinet 22, that is to say, the slide rails of each slide rail assembly of the cabinet 22 can be set in a retractable state. When one of the drawers (such as the first drawer 24*a* or the slide rails of the related slide rail assembly) is pulled open in an actuation direction D, the other drawers (such as the second drawer 24*b*, the third drawer 24*c* and the fourth drawer 24*d*) can be locked by the slide rail mechanism and cannot be pulled open with respect to the cabinet 22.

Figure 10:
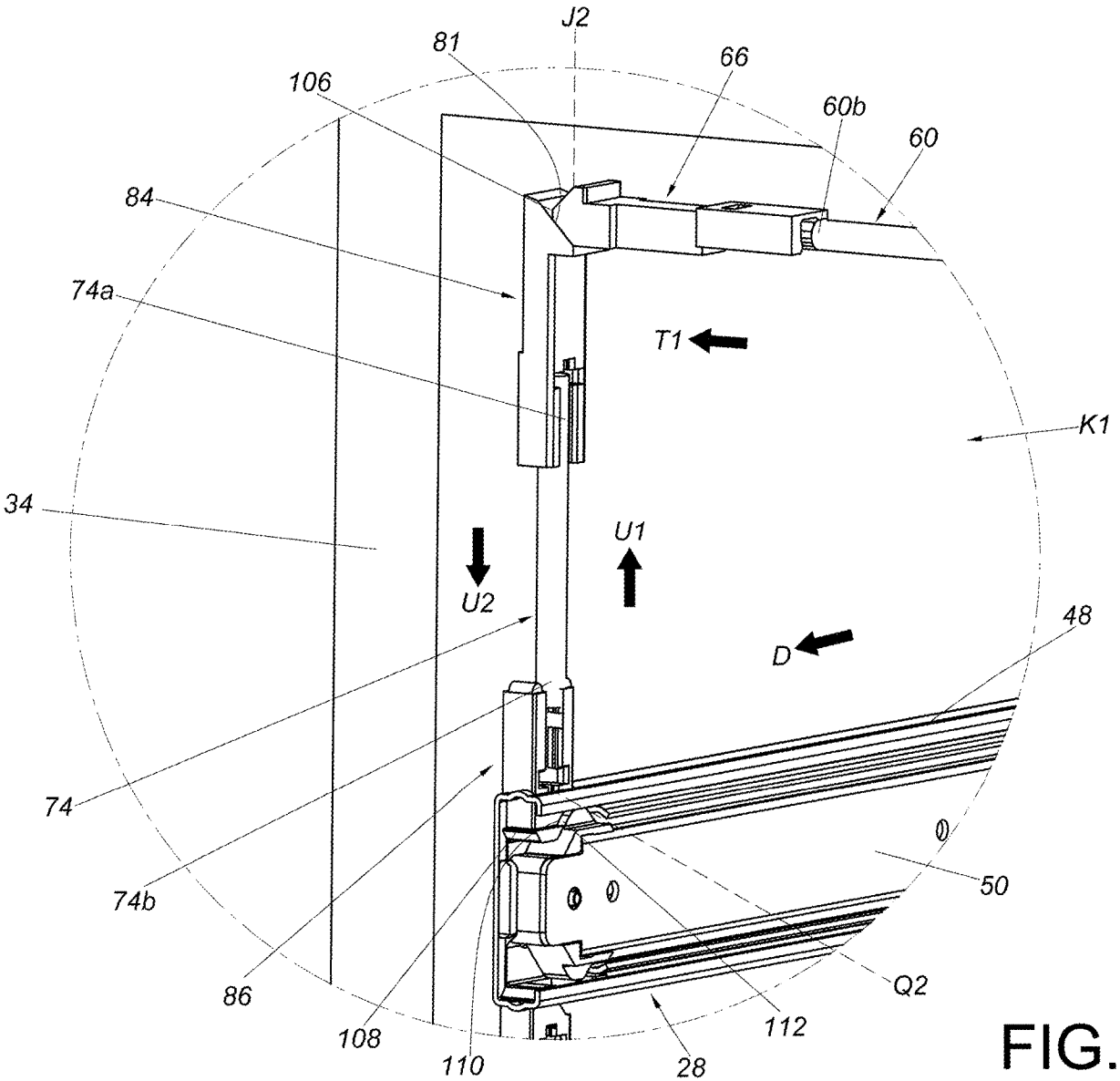
FIG. 10 is an enlarged diagram of an area F shown in FIG. 8.

As shown in FIG. 4 to FIG. 6 and FIG. 9 to FIG. 11, when the second rail 46 (or the first drawer 24*a*) is shifted with respect to the first rail 44 (or the cabinet 22) of the first slide rail assembly 26 from a first retracted position (as shown in FIG. 4) in the actuation direction D (which can be shown in FIG. 9), the first working member 60 can be driven to shift in a first transverse direction T1 (which can be shown in FIG. 9 and FIG. 10), so as to prevent the fourth rail 50 of the second slide rail assembly 28 from being shifted with respect to the third rail 48 from a second retracted position in the actuation direction D (which can be shown in FIG. 10).

Figure 11:
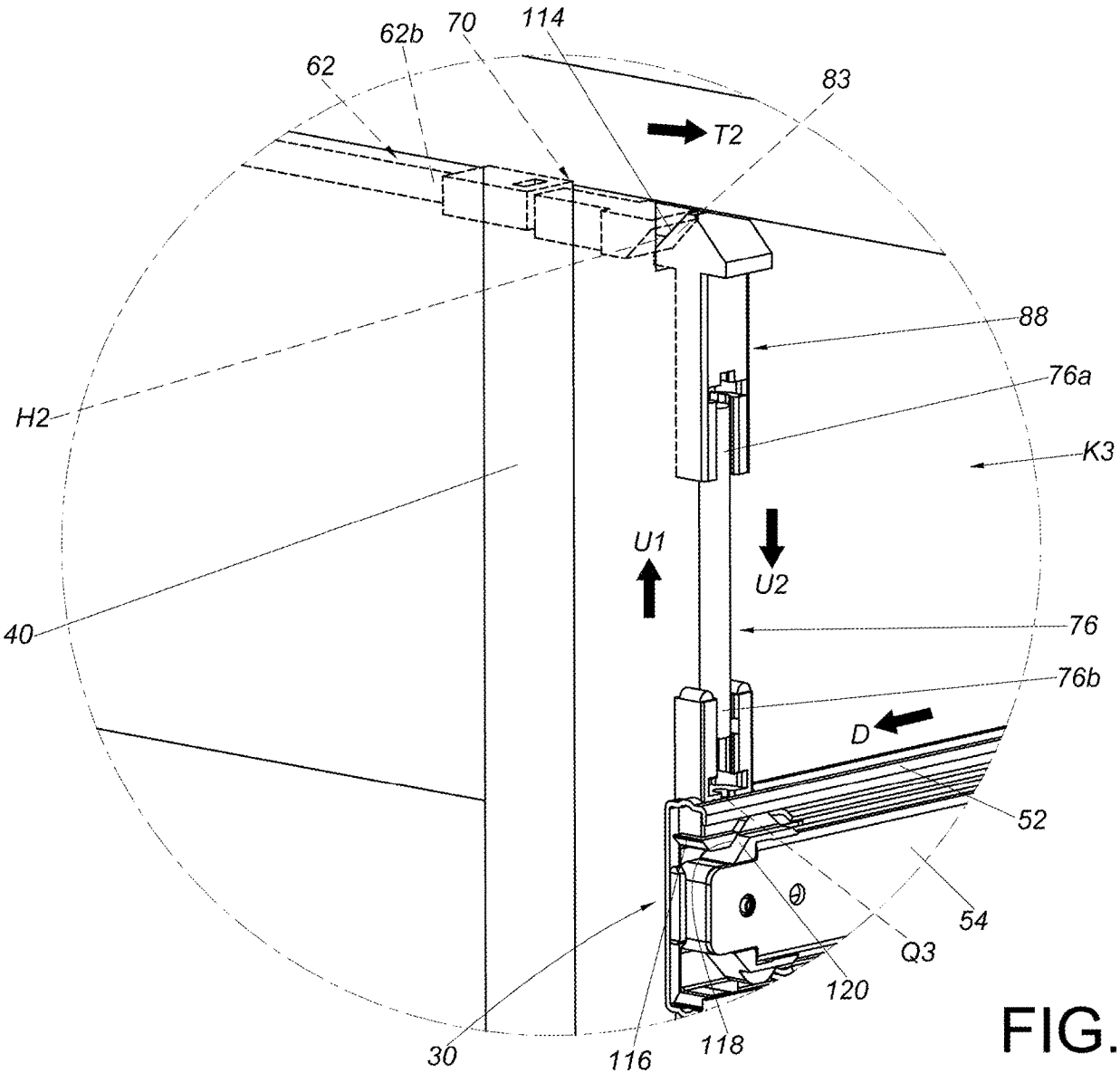
FIG. 11 is an enlarged diagram of an area G shown in FIG. 8.

Preferably, when the second rail 46 is shifted with respect to the first rail 44 of the first slide rail assembly 26 from the first retracted position (which can be shown in FIG. 4) in the actuation direction D, the second working member 62 can be driven to shift in a second transverse direction T2 (which can be shown in FIG. 9 and FIG. 11) opposite to the first transverse direction T1, so as to prevent the sixth rail 54 of the third slide rail assembly 30 from being shifted with respect to the fifth rail 52 from a third retracted position in the actuation direction (which can be shown in FIG. 11).

Preferably, when the second rail 46 is shifted with respect to the first rail 44 of the first slide rail assembly 26 from the first retracted position in the actuation direction D, the second rail 46 of the first slide rail assembly 26 can drive the first auxiliary member 72 to shift the first working member 60 and the second working member 62 respectively in the first transverse direction T1 and the second transverse direction T2 (which can be shown in FIG. 9), so as to prevent the fourth rail 50 of the second slide rail assembly 28 from being shifted with respect to the third rail 48 from the second retracted position in the actuation direction D (which can be shown in FIG. 10), and further to prevent the sixth rail 54 of the third slide rail assembly 30 from being shifted with respect to the fifth rail 52 from the third retracted position in the actuation direction D (which can be shown in FIG. 11).

For example, when the second rail 46 is shifted with respect to the first rail 44 of the first slide rail assembly 26 from the first retracted position in the actuation direction D, the second rail 46 of the first slide rail assembly 26 can drive the first auxiliary member 72 to abut the first guiding portion 96 of the first stretching member 80 against the first guiding section 77 of the first driving member 64 arranged on the first working member 60 for generating a force and then driving the first working member 60 to shift in the first transverse direction T1 (which can be shown in FIG. 9 and FIG. 10), and the first auxiliary member 72 can be further configured to abut the second guiding portion 98 of the first stretching member 80 against the second guiding section 79 of the third driving member 68 arranged on the second working member 62 for generating the force and then driving the second working member 62 to shift in the second transverse direction T2 (which can be shown in FIG. 9 and FIG. 11), so as to prevent the fourth rail 50 of the second slide rail assembly 28 from being shifted with respect to the third rail 48 from the second retracted position in the actuation direction D (which can be shown in FIG. 10), and further to prevent the sixth rail 54 of the third slide rail assembly 30 from being shifted with respect to the fifth rail 52 from the third retracted position in the actuation direction D (which can be shown in FIG. 11).

Preferably, when the second rail 46 is shifted with respect to the first rail 44 of the first slide rail assembly 26 from the first retracted position in the actuation direction D (which can be shown in FIG. 9), the second rail 46 of the first slide rail assembly 26 can utilize relative contact between the first corresponding feature 104 and the first guiding feature 102 of the second stretching member 82 to generate the force for driving the first auxiliary member 72 to shift in a first height direction U1, and the first auxiliary member 72 can drive the first working member 60 to shift in the first transverse direction T1 (which can be shown in FIG. 9 and FIG. 10), so as to block a movement path of the second auxiliary member 74; for example, the second auxiliary member 74 maybe blocked by the second driving member 66 arranged on the first working member 60 and cannot be shifted in the first height direction U1 (which can be shown in FIG. 10), and the fourth rail 50 of the second slide rail assembly 28 can be blocked by the second auxiliary member 74 to prevent the fourth rail 50 of the second slide rail assembly 28 from being shifted with respect to the third rail 48 from the second retracted position in the actuation direction D.

Preferably, when the first working member 60 is shifted in the first transverse direction T1, the first working member 60 can utilize relative contact between a third guiding section 81 of the second driving member 66 and the third guiding portion 106 of the third stretching member 84 to press the second auxiliary member 74 in a second height direction U2 opposite to the first height direction U1 (which can be shown in FIG. 10).

Preferably, when the second rail 46 is shifted with respect to the first rail 44 of the first slide rail assembly 26 from the first retracted position in the actuation direction D (which can be shown in FIG. 9), the second rail 46 of the first slide rail assembly 26 can utilize relative contact between the first corresponding feature 104 and the first guiding feature 102 of the second stretching member 82 to generate the force for driving the first auxiliary member 72 to shift the second working member 62 in the second transverse direction T2 (which can be shown in FIG. 9 and FIG. 11) and further to block the movement path of the third auxiliary member 76; for example, the third auxiliary member 76 can be blocked by the fourth driving member 70 arranged on the second working member 62 and cannot be shifted in the first height direction U1 (which can be shown in FIG. 11), and the sixth rail 54 of the third slide rail assembly 30 can be blocked by the third auxiliary member 76 to prevent the sixth rail 54 of the third slide rail assembly 30 from being shifted with respect to the fifth rail 52 from the third retracted position in the actuation direction D. Preferably, when the second working member 62 is shifted in the second transverse direction T2, the second working member 62 can utilize relative contact between the fourth guiding section 83 of the fourth driving member 70 and the fourth guiding portion 114 of the fifth stretching member 88 to press the third auxiliary member 76 in the second height direction U2 (which can be shown in FIG. 11).

Figure 12:
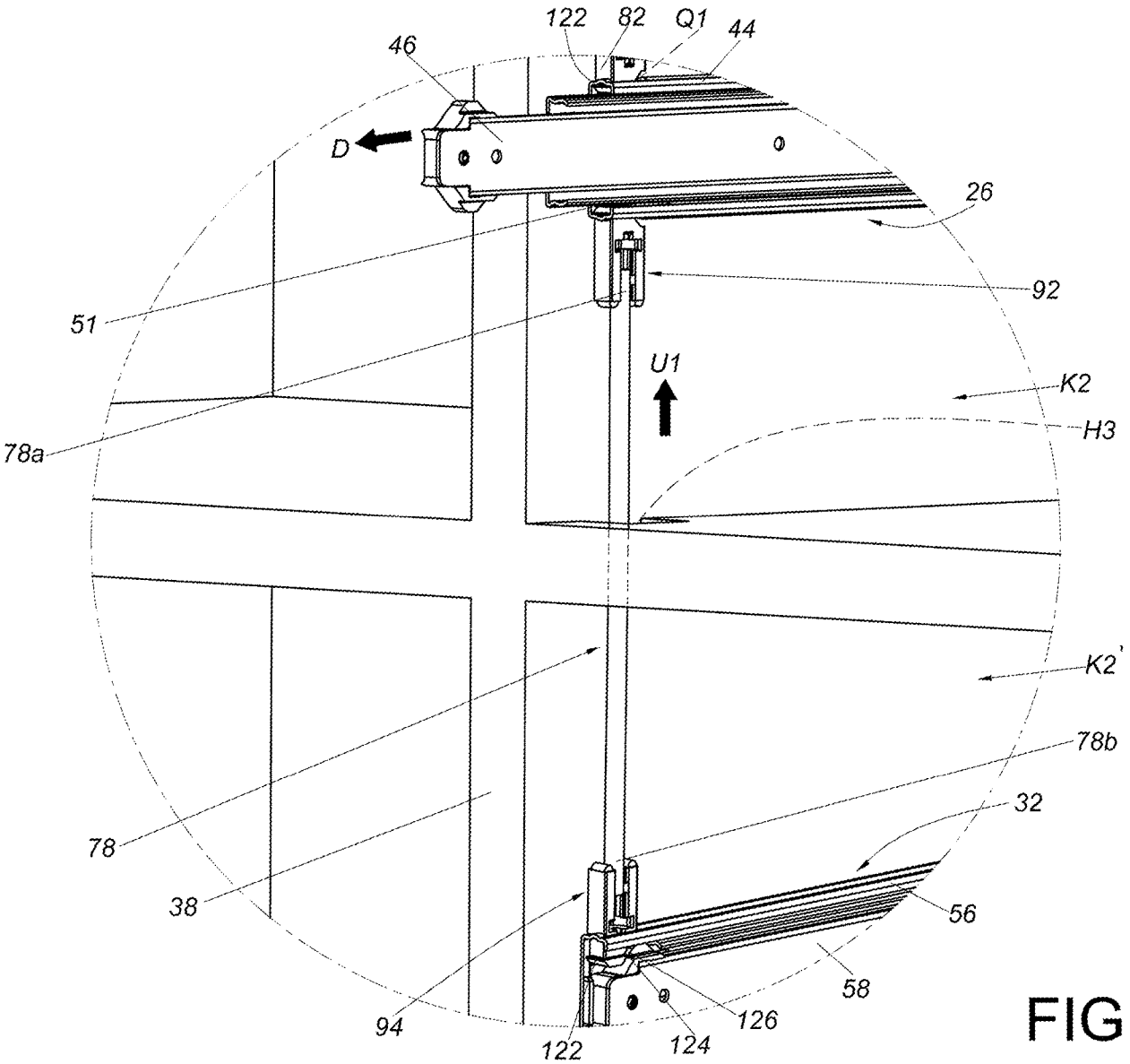
FIG. 12 is an enlarged diagram of an area H shown in FIG. 8.

As shown in FIG. 7 and FIG. 12, when the second rail 46 (and a middle rail 51) is shifted with respect to the first rail 44 of the first slide rail assembly 26 from the first retracted position (which can be shown in FIG. 7) in the actuation direction D (which can be shown in FIG. 12), the movement path of the fourth auxiliary member 78 can be blocked by the second rail 46 of the first slide rail assembly 26; for example, the fourth auxiliary member 78 (or the seventh stretching member 92) can be blocked by the second rail 46 or the middle rail 51 of the first slide rail assembly 26 and cannot be shifted in the first height direction U1 (which can be shown in FIG. 12), and the eighth rail 58 of the fourth slide rail assembly 32 can be blocked by the fourth auxiliary member 78, so as to prevent the eighth rail 58 of the fourth slide rail assembly 32 from being shifted with respect to the seventh rail 56 form a fourth retracted position in the actuation direction D (which can be shown in FIG. 12).

Figure 13:
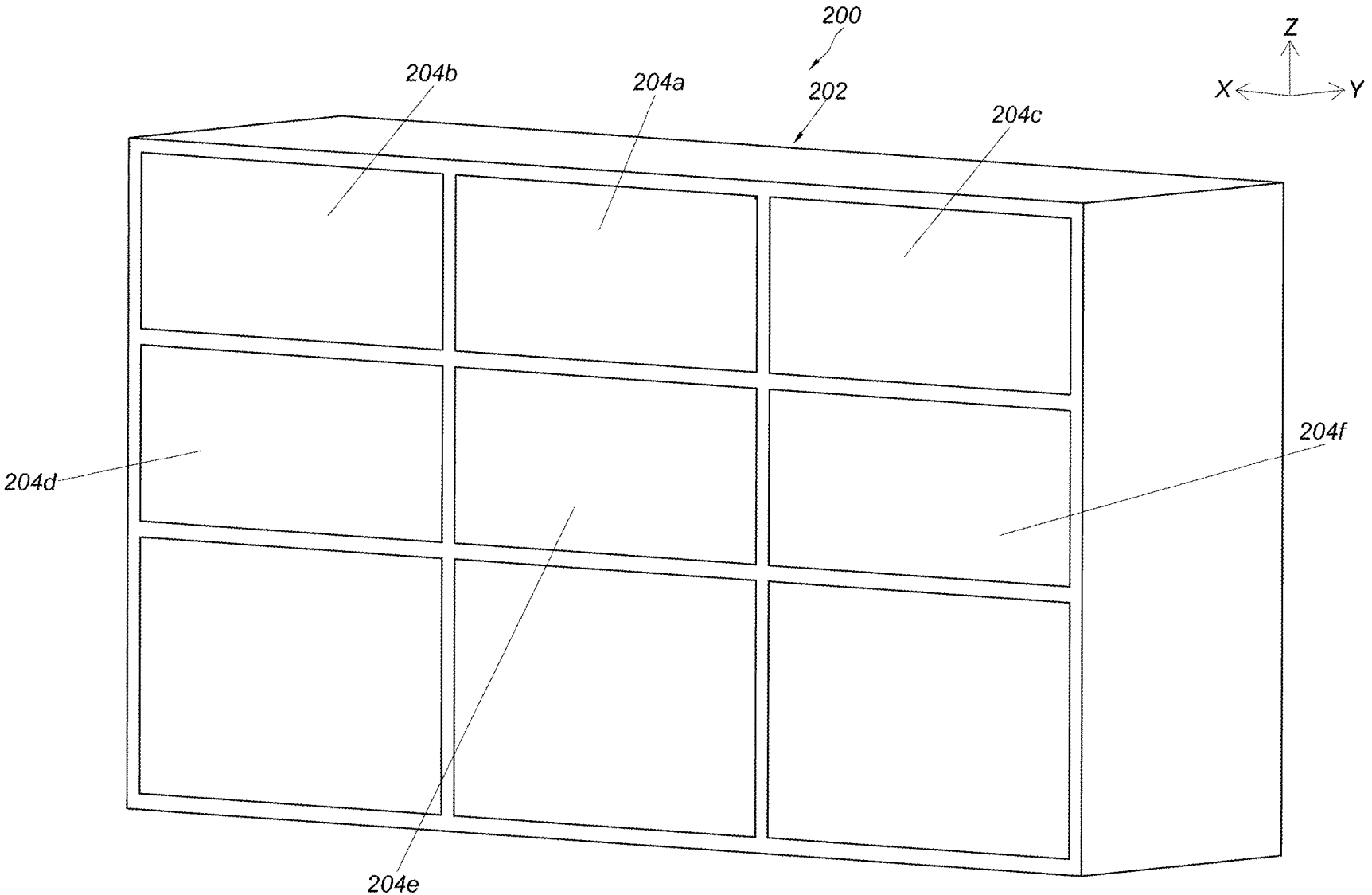
FIG. 13 is a diagram of furniture including the cabinet and the plurality of drawers according to a second embodiment of the present application.
Figure 14:
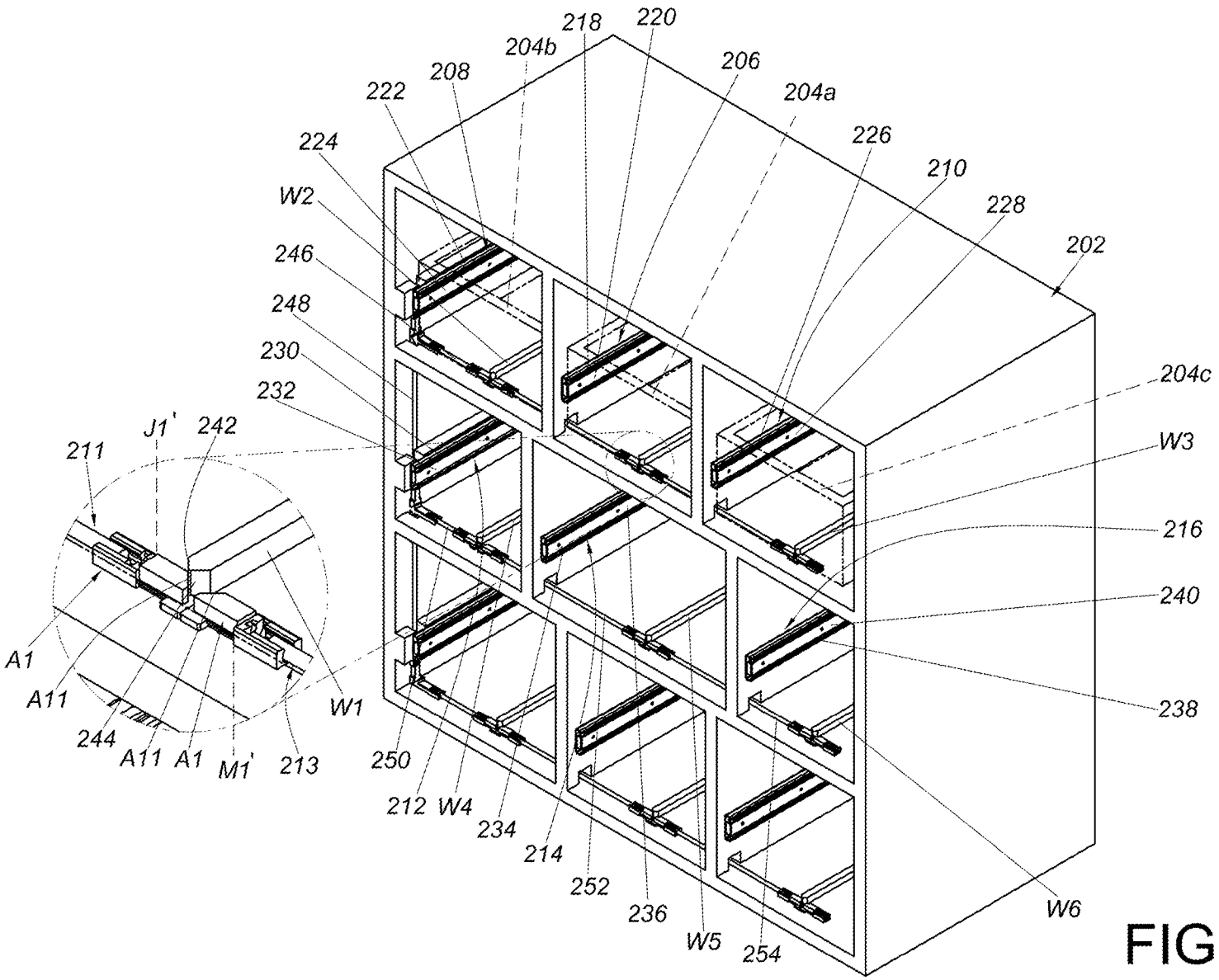
FIG. 14 is a diagram of the slide rail mechanism applied to the cabinet according to the second embodiment of the present application.

As shown in FIG. 13 and FIG. 14, the slide rail mechanism of a second embodiment of the present application can be applied for the cabinet. In the first embodiment, the slide rail mechanism can utilize a mode switching function of the rail (or the related drawer) of the slide rail assembly to lock the rail (or the related drawer) of another slide rail assembly; in the second embodiment, the slide rail mechanism can utilize a mode switching function of the drawer (or the related rail) to lock another drawer (or the related rail).

In the second embodiment of the present application, furniture 200 can include a cabinet 202, and the plurality of drawers can be arranged inside the cabinet 202 in the transverse direction (such as the lateral arrangement) and further in the vertical direction, such as a first drawer 204*a*, a second drawer 204*b*, a third drawer 204*c*, a fourth drawer 204*d*, a fifth drawer 204*e* and a sixth drawer 204*f*, and others are omitted herein for simplicity. The drawers can be pulled open and pushed into the cabinet 202.

The slide rail mechanism can be arranged inside the cabinet 202, and can include the plurality of slide rail assemblies configured to respectively hold the first drawer 204*a*, the second drawer 204*b*, the third drawer 204*c*, the fourth drawer 204*d*, the fifth drawer 204*e* and the sixth drawer 204*f*, such as a first slide rail assembly 206, a second slide rail assembly 208, a third slide rail assembly 210, a fourth slide rail assembly 212, a fifth slide rail assembly 214 and a sixth slide rail assembly 216. The foresaid slide rail assemblies 206, 208, 210, 212, 214 and 216 can be arranged inside the cabinet 202, and each of the foresaid slide rail assemblies 206, 208, 210, 212, 214 and 216 can include at least one rails being shiftable with respect to each other.

The slide rail mechanism can include a first working member 211, and further preferably include a second working member 213. The first working member 211 and the second working member 213 can be shiftable with respect to the cabinet 202.

For example, the first slide rail assembly 206 can include a first rail 218 and a second rail 220, and the second rail 220 can be shiftable with respect to the first rail 218 in the longitudinal direction. The second slide rail assembly 208 can include a third rail 222 and a fourth rail 224, and the fourth rail 224 can be shiftable with respect to the third rail 222 in the longitudinal direction. The third slide rail assembly 210 can include a fifth rail 226 and a sixth rail 228, and the sixth rail 228 can be shiftable with respect to the fifth rail 226 in the longitudinal direction. The fourth slide rail assembly 212 can include a seventh rail 230 and an eighth rail 232, and the eighth rail 232 can be shiftable with respect to the seventh rail 230 in the longitudinal direction. The fifth slide rail assembly 214 can include a ninth rail 234 and a tenth rail 236, and the tenth rail 236 can be shiftable with respect to the ninth rail 234 in the longitudinal direction. The sixth slide rail assembly 216 can include an eleventh rail 238 and a twelfth rail 240, and the twelfth rail 240 can be shiftable with respect to the eleventh rail 238 in the longitudinal direction.

The second rail 220 of the first slide rail assembly 206, the fourth rail 224 of the second slide rail assembly 208, the sixth rail 228 of the third slide rail assembly 210, the eighth rail 232 of the fourth slide rail assembly 212, the tenth rail 236 of the fifth slide rail assembly 214, and the twelfth rail 240 of the sixth slide rail assembly 216 can be respectively configured to hold the first drawer 204*a*, the second drawer 204*b*, the third drawer 204*c*, the fourth drawer 204*d*, the fifth drawer 204*e* and the sixth drawer 204*f*.

Preferably, a first accessory W1, a second accessory W2, a third accessory W3, a fourth accessory W4, a fifth accessory W5 and a sixth accessory W6 can be respectively arranged on the first drawer 204*a*, the second drawer 204*b*, the third drawer 204*c*, the fourth drawer 204*d*, the fifth drawer 204*e* and the sixth drawer 204*f*. Each of the foresaid accessories can have the same or similar structures. As an example of the first accessory W1, the first accessory W1 can be located on the bottom of the first drawer 204*a*, and includes a first guiding portion 242 and a second guiding portion 244. The first guiding portion 242 and the second guiding portion 244 can be the inclined typed structure or the arc typed structure; application of the first guiding portion 242 and the second guiding portion 244 is not limited to the foresaid embodiment, and depends on the design demand.

Preferably, the slide rail mechanism can further include a third working member 246, an auxiliary member 248, a fourth working member 250, a fifth working member 252 and a sixth working member 254, which are linked with at least one of the first working member 211 and the second working member 213.

Figure 18:
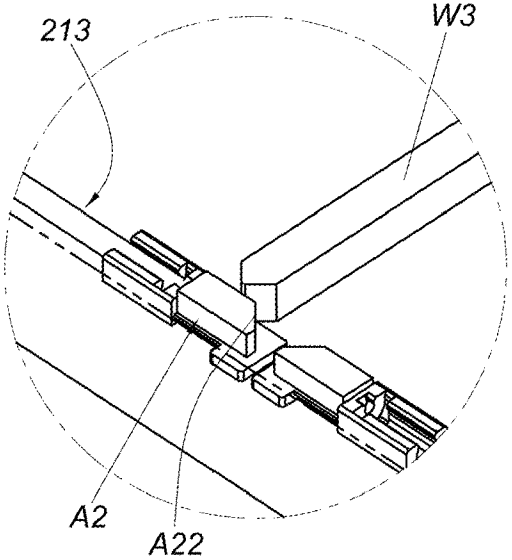
FIG. 18 is an enlarged diagram of an area C' shown in FIG. 15.
Figure 17:
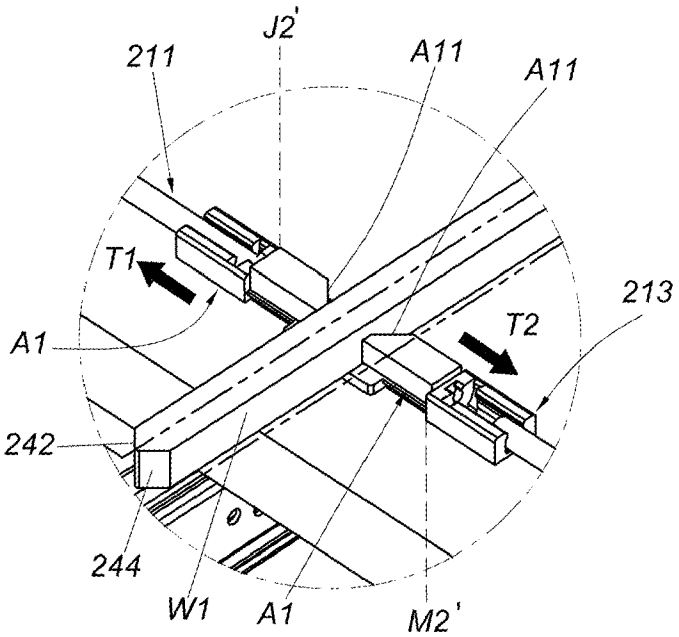
FIG. 17 is an enlarged diagram of an area A' shown in FIG. 15.

Preferably, a first driving member A1 and a second driving member A2 can be respectively arranged on two ends of each of the first working member 211, the second working member 62, the third working member 246, the fourth working member 250, the fifth working member 252, the sixth working member 254 and the auxiliary member 248. Each of the first driving member A1 and the second driving member A2 can have a first guiding section A11 and a second guiding section A22. The first guiding section A11 and the second guiding section A22 can be the inclined typed structure or the arc typed structure; application of the first guiding section A11 and the second guiding section A22 is not limited to the foresaid embodiment, and depends on the design demand (which can be shown in FIG. 14). Further, as shown in FIG. 16 and FIG. 17, the first driving member A1 can be arranged on the first end portion of the first working member 211, and the second driving member A2 can be arranged on the second end portion of the first working member 211; similarly, as shown in FIG. 17 and FIG. 18, the first driving member A1 can be arranged on the first end portion of the second working member 213, and the second driving member A2 can be arranged on the second end portion of the second working member 213.

When the drawers 204*a*, 204*b*, 204*c*, 204*d*, 204*e* and 204*f* are pushed into the cabinet 202, the first working member 211, the second working member 62, the third working member 246, the fourth working member 250, the fifth working member 252, the sixth working member 254 and the auxiliary member 248 can be set in an initial mode, such as being located on an initial position; in the initial mode, any of the drawers can be pulled open, and the first working member 211 can be located on a first working position J1' and the second working member 213 can be located on a first preset position M1'.

Figure 15:
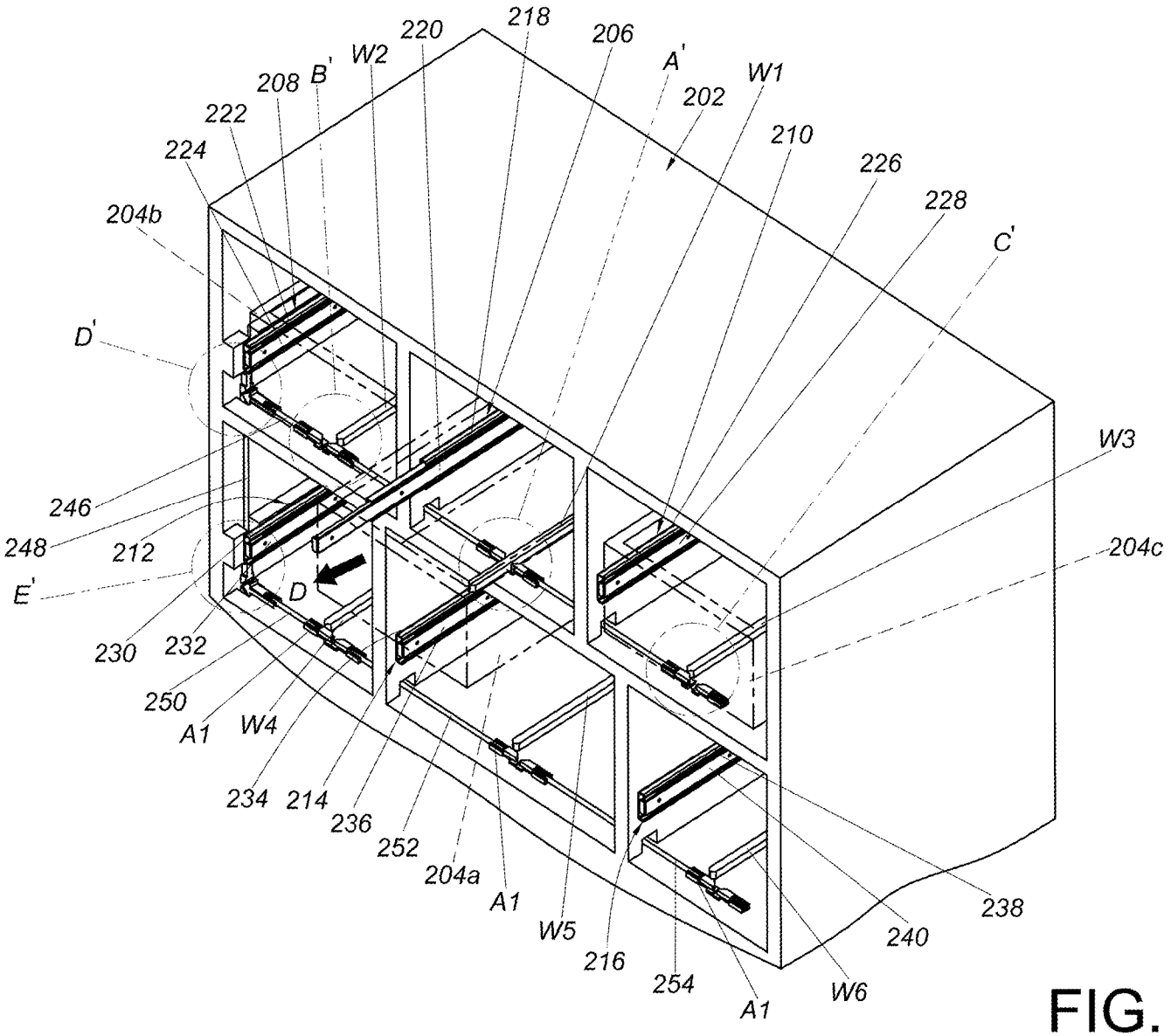
FIG. 15 is a diagram of a part of the cabinet according to the second embodiment of the present application.
Figure 16:
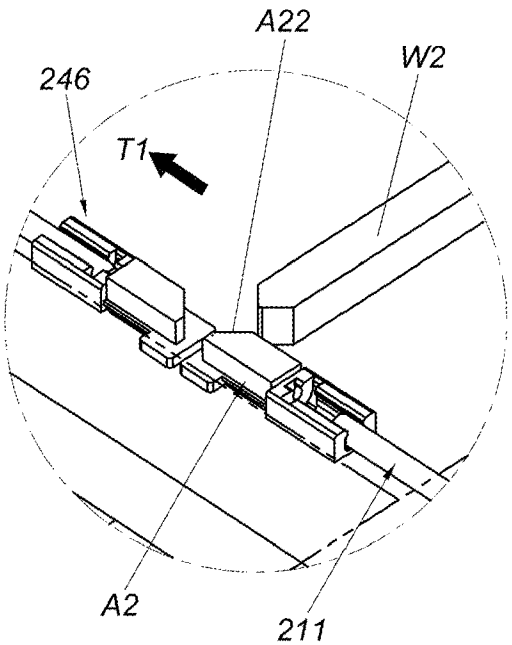
FIG. 16 is an enlarged diagram of an area B' shown in FIG. 15.

As shown in FIG. 15 to FIG. 18, when the first drawer 204*a* is shifted in the actuation direction D (which can be shown in FIG. 15 or FIG. 17), the first working member 211 can be driven by the first accessory W1 to shift from the first working position J1' to a second working position J2' in the first transverse direction T1 (which can be shown in FIG. 17 and FIG. 16), and the second accessory W2 of the second drawer 204*b* can be blocked by the second driving member A2 arranged on the first working member 211, so as to prevent the second drawer 204*b* from being shifted in the actuation direction D (which can be shown in FIG. 15 and FIG. 16). Preferably, the second working member 213 can be driven by the first accessory W1 to move from the first preset position M1' to the second preset position M2' in the second transverse direction T2 (which can be shown in FIG. 17 and FIG. 18), and the third accessory W3 of the third drawer 204*c* can be blocked by the second driving member A2 arranged on the second working member 213 (which can be shown in FIG. 18), so as to prevent the third drawer 204*c* from being shifted in the actuation direction D.

Figure 19:
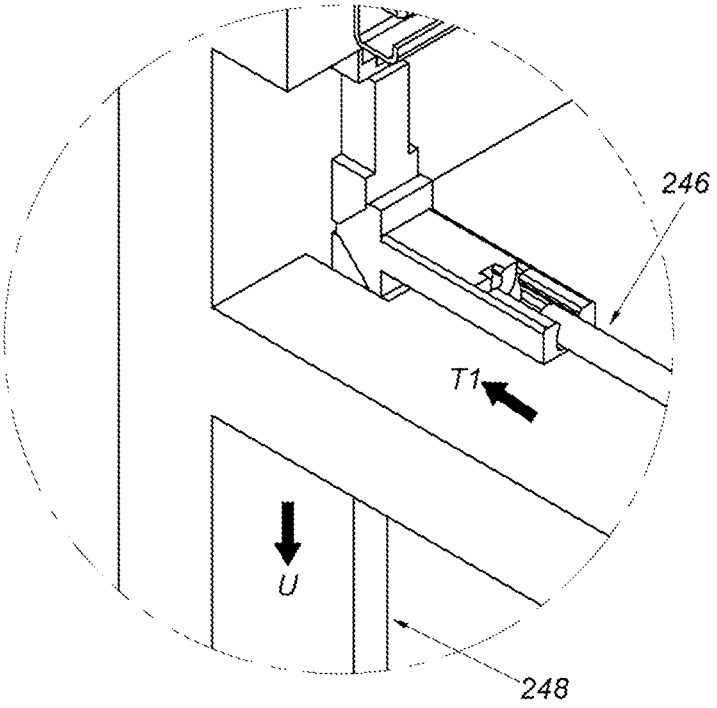
FIG. 19 is an enlarged diagram of an area D' shown in FIG. 15.
Figure 20:
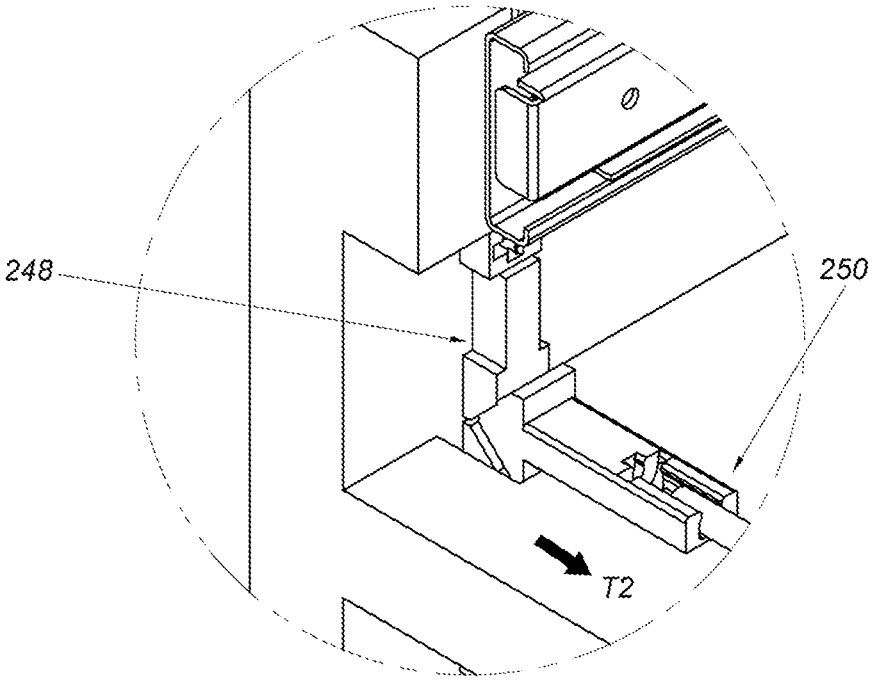
FIG. 20 is an enlarged diagram of an area E' shown in FIG. 15.

Preferably, when first working member 211 is shifted to the second working position J2' in the first transverse direction T1, the first working member 211 can drive the third working member 246 (which can be shown in FIG. 16) to shift the auxiliary member 248 in a height direction U (which can be shown in FIG. 19), for further shifting the fourth working member 250 in the second transverse direction T2 (which can be shown in FIG. 20); the fourth accessory W4 of the fourth drawer 204*d* can be blocked by the first driving member A1 arranged on the fourth working member 250 (which can be shown in FIG. 13 and FIG. 14), so as to prevent the fourth drawer 204*d* from being shifted in the actuation direction D. When the fourth working member 250 is shifted in the second transverse direction T2, the fourth working member 250 can drive the fifth working member 252 to shift in the second transverse direction T2, and the fifth accessory W5 of the fifth drawer 204*e* can be blocked by the first driving member A1 arranged on the fifth working member 252 (which can be shown in FIG. 15), so as to prevent the fifth drawer 204*e* from being shifted in the actuation direction D. When the fifth working member 252 is shifted in the second transverse direction T2, the fifth working member 252 can shift the sixth working member 254 in the second transverse direction T2, and the sixth accessory W6 of the sixth drawer 204*f* can be blocked by the first driving member A1 arranged on the sixth working member 254 (which can be shown in FIG. 15), so as to prevent the sixth drawer 204*f* from being shifted in the actuation direction D.

Therefore, the slide rail mechanism provided by the embodiment of the present application can have following features: when the second rail 46 (or the related first drawer 24*a*) of the first slide rail assembly 26 is pulled open, the first working member 60 can be shifted in the first transverse direction T1 to block (or lock) the fourth rail 50 (or the related second drawer 24*b*) of the second slide rail assembly 28 arranged on an upright row of the first side of the cabinet 22; similarly, when the second rail 46 (or the related first drawer 24*a*) of the first slide rail assembly 26 is pulled open, the second working member 62 can be shifted in the second transverse direction T2 to block (or lock) the sixth rail 54 (or the third drawer 24*c*) of the third slide rail assembly 30 arranged on the upright row of the second side of the cabinet 22.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism configured to a cabinet, the slide rail mechanism comprising:

a first slide rail assembly and a second slide rail assembly arranged on the cabinet;

a first auxiliary member vertically shiftable with respect to the cabinet;

a first working member shiftable with respect to the cabinet;

a third slide rail assembly; and a second working member;

wherein the first slide rail assembly comprises a first rail and a second rail, the second rail is shiftable with respect to the first rail in a longitudinal direction, the second slide rail assembly comprises a third rail and a fourth rail, and the fourth rail is shiftable with respect to the third rail in the longitudinal direction;

wherein the third slide rail assembly is arranged on the cabinet and comprises a fifth rail and a sixth rail, the sixth rail is shiftable with respect to the fifth rail in the longitudinal direction, the second working member is shiftable with respect to the cabinet;

wherein when the second rail is shifted with respect to the first rail of the first slide rail assembly in an actuation direction, the second rail of the first slide rail assembly drives the first auxiliary member, and the first working member and the second working member are driven by the first auxiliary member to respectively shift in a first transverse direction and a second transverse direction, so as to prevent the fourth rail from being shifted with respect to the third rail of the second slide rail assembly in the actuation direction, and further prevent the sixth rail from being shifted with respect to the fifth rail of the third slide rail assembly in the actuation direction;

wherein the first transverse direction is opposite to the second transverse direction.

2. The slide rail mechanism of claim 1, wherein the first auxiliary member has a first end portion and a second end portion, a first stretching member is arranged on the first end portion of the first auxiliary member, and a second stretching member is arranged on the second end portion of the first auxiliary member, so that the first auxiliary member is movably mounted on the first rail of the first slide rail assembly via the second stretching member.

3. The slide rail mechanism of claim 2, wherein the first working member has a first end portion and a second end portion, a first driving member is arranged on the first end portion of the first working member, the first driving member has a first guiding section configured to be used with a first guiding portion of the first stretching member.

4. The slide rail mechanism of claim 3, wherein the second working member has a first end portion and a second end portion, a third driving member is arranged on the first end portion of the second working member, the third driving member has a second guiding section configured to be used with a second guiding portion of the first stretching member.

5. The slide rail mechanism of claim 1, further comprising:

a second auxiliary member shiftable with respect to the cabinet;

wherein when the second rail is shifted with respect to the first rail of the first slide rail assembly in the actuation direction, the second rail of the first slide rail assembly drives the first auxiliary member, and the first working member is driven by the first auxiliary member to shift in the first transverse direction, so as to block a movement path of the second auxiliary member for further blocking the fourth rail of the second slide rail assembly by the second auxiliary member, and further to prevent the fourth rail from being shifted with respect to the third rail of the second slide rail assembly in the actuation direction.

6. The slide rail mechanism of claim 5, wherein the second auxiliary member is vertically shiftable with respect to the cabinet.

7. The slide rail mechanism of claim 5, further comprising:

a third auxiliary member shiftable with respect to the cabinet;

wherein when the second rail is shifted with respect to the first rail of the first slide rail assembly in the actuation direction, the second rail of the first slide rail assembly drives the first auxiliary member, and the second working member is driven by the first auxiliary member to shift in the second transverse direction, so as to block a movement path of the third auxiliary member for further blocking the sixth rail of the third slide rail assembly by the third auxiliary member, and further to prevent the sixth rail from being shifted with respect to the fifth rail of the third slide rail assembly in the actuation direction.

8. The slide rail mechanism of claim 7, wherein the third auxiliary member is vertically shiftable with respect to the cabinet.

9. The slide rail mechanism of claim 7, further comprising:

a fourth slide rail assembly and a fourth auxiliary member, the fourth slide rail assembly and the first slide rail assembly being vertically arranged on the cabinet, the fourth slide rail assembly comprising a seventh rail and an eighth rail, the eighth rail being shiftable with respect to the seven rail in the longitudinal direction, and the fourth auxiliary member being shiftable with respect to the cabinet;

wherein when the second rail is shifted with respect to the first rail of the first slide rail assembly in the actuation direction, the second rail of the first slide rail assembly blocks a movement path of the fourth auxiliary member for further blocking the eighth rail of the fourth slide rail assembly by the fourth auxiliary member, so as to prevent the eighth rail from being shifted with respect to the seventh rail of the fourth slide rail assembly in the actuation direction.

10. The slide rail mechanism of claim 9, wherein the fourth auxiliary member is vertically shiftable with respect to the cabinet.

11. The slide rail mechanism of claim 1, wherein the first slide rail assembly, the second slide rail assembly and the third slide rail assembly are transversely arranged on the cabinet.

12. The slide rail mechanism of claim 1, wherein the second rail of the first slide rail assembly is configured to hold a first drawer, and the fourth rail is configured to hold a second drawer; a first accessory and a second accessory are respectively arranged on the first drawer and the second drawer; when the first drawer is shifted in the actuation direction, the first working member is driven by the first accessory to shift in the first transverse direction for blocking the second accessory of the second drawer, so as to prevent the second drawer from being shifted in the actuation direction.

13. The slide rail mechanism of claim 1, wherein the second rail of the first slide rail assembly is configured to hold a first drawer, the fourth rail is configured to hold a second drawer, and the sixth rail is configured to hold a third drawer; a first accessory, a second accessory and a third accessory are respectively arranged on the first drawer, the second drawer and the third drawer;

when the first drawer is shifted in the actuation direction, the second working member is driven by the first accessory to shift in the second transverse direction for blocking the third accessory of the third drawer, so as to prevent the third drawer from being shifted in the actuation direction.

14. The slide rail mechanism of claim 13, further comprising:

a fourth slide rail assembly, a third working member, an auxiliary member and a fourth working member;

wherein the fourth slide rail assembly comprises a seventh rail and an eighth rail, the eighth rail is shiftable with respect to the seventh rail, and the eighth rail is configured to hold a fourth drawer; a fourth accessory is arranged on the fourth drawer;

wherein when the first drawer is shifted in the actuation direction, the first working member is driven by the first accessory to shift in the first transverse direction, and the first working member drives the third working member to shift in the first transverse direction, so that the third working member drives the auxiliary member to shift in a height direction, for driving the fourth working member to shift in the second transverse direction and further to block the fourth accessory of the fourth drawer, so as to prevent the fourth drawer from being shifted in the actuation direction.

15. The slide rail mechanism of claim 14, further comprising:

a fifth slide rail assembly and a fifth working member;

wherein the fifth slide rail assembly comprises a ninth rail and a tenth rail, the tenth rail is shiftable with respect to the ninth rail, and the tenth rail is configured to hold a fifth drawer; a fifth accessory is arranged on the fifth drawer;

wherein when the first drawer is shifted in the actuation direction, the first working member is driven by the first accessory to shift in the first transverse direction, and the first working member drives the third working member to shift in the first transverse direction, so that the third working member drives the auxiliary member to shift in the height direction for driving the fourth working member to shift in the second transverse direction, and the fourth working member drives the fifth working member to block the fifth accessory of the fifth drawer, so as to prevent the fifth drawer from being shifted in the actuation direction.

16. The slide rail mechanism of claim 15, further comprising:

a sixth slide rail assembly and a sixth working member;

wherein the sixth slide rail assembly comprises an eleventh rail and a twelfth rail, the twelfth rail is shiftable with respect to the eleventh rail, and the twelfth rail is configured to hold a sixth drawer; a sixth accessory is arranged on the sixth drawer;

wherein when the first drawer is shifted in the actuation direction, the first working member is driven by the first accessory to shift in the first transverse direction, and the first working member drives the third working member to shift in the first transverse direction, so that the third working member drives the auxiliary member to shift in the height direction for driving the fourth working member to shift in the second transverse direction, and the fourth working member drives the fifth working member for driving the sixth working member to shift in the second transverse direction, and therefore the sixth working member blocks the sixth accessory of the sixth drawer to prevent the sixth drawer from being shifted in the actuation direction.

* * * * *